US008182063B2

(12) United States Patent
Hanaoka

(10) Patent No.: US 8,182,063 B2
(45) Date of Patent: May 22, 2012

(54) LIQUID CONTAINER

(75) Inventor: Yukihiro Hanaoka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 794 days.

(21) Appl. No.: 11/839,179

(22) Filed: Aug. 15, 2007

(65) Prior Publication Data

US 2007/0296777 A1 Dec. 27, 2007

Related U.S. Application Data

(63) Continuation of application No. 10/897,713, filed on Jul. 23, 2004, now Pat. No. 7,290,869.

(30) Foreign Application Priority Data

Jul. 25, 2003 (JP) ..... 2003-201887

(51) Int. Cl.
*B41J 2/165* (2006.01)
*B41J 2/17* (2006.01)
*B41J 2/175* (2006.01)

(52) U.S. Cl. ..... 347/36; 347/84; 347/85; 347/86

(58) Field of Classification Search ..... 347/84–86, 347/43, 36

See application file for complete search history.

(56) References Cited

U.S. PATENT DOCUMENTS

| | | | | |
|---|---|---|---|---|
| 4,673,955 | A | 6/1987 | Ameyama et al. | |
| 5,359,353 | A | 10/1994 | Hunt et al. | |
| 5,784,087 | A | 7/1998 | Wallace et al. | |
| 5,907,343 | A * | 5/1999 | Takemura et al. | 347/108 |
| 6,264,319 | B1 | 7/2001 | Altfather et al. | |
| 6,281,911 | B1 * | 8/2001 | Nakazawa et al. | 347/36 |
| 6,863,388 | B2 * | 3/2005 | Seino et al. | 347/86 |
| 7,018,029 | B2 | 3/2006 | Ishizawa et al. | |
| 7,052,121 | B2 | 5/2006 | Yamada | |
| 2001/0024225 | A1 | 9/2001 | Ishizawa et al. | |
| 2001/0048457 | A1 | 12/2001 | Hara et al. | |
| 2002/0145651 | A1 | 10/2002 | Hayashi et al. | |
| 2003/0184622 | A1 * | 10/2003 | Sasaki et al. | 347/85 |
| 2003/0184623 | A1 | 10/2003 | Sasaki et al. | |
| 2003/0184626 | A1 | 10/2003 | Sasaki et al. | |
| 2003/0184627 | A1 | 10/2003 | Sasaki et al. | |
| 2003/0184628 | A1 | 10/2003 | Sasaki | |
| 2004/0165044 | A1 * | 8/2004 | Yamada | 347/86 |

FOREIGN PATENT DOCUMENTS

| | | |
|---|---|---|
| EP | 965 451 | 12/1999 |
| EP | 1 431 038 A2 | 6/2004 |
| JP | 59-115861 A | 7/1984 |

(Continued)

*Primary Examiner* — Jason Uhlenhake

(74) *Attorney, Agent, or Firm* — Stroock & Stroock & Lavan LLP

(57) ABSTRACT

A multicolor-use ink cartridge has obverse surface-side ink chambers and formed on an obverse surface side of a horizontal plate portion of a rigid plastic plate and reverse surface-side ink chambers and formed on a reverse surface side thereof. Since these ink chambers are arranged in a breadthwise direction so as to be staggered in a mutually overlapping state with the horizontal plate portion interposed therebetween, it is possible to make small the dimension in a direction in which the ink chambers are arranged. The respective ink chambers are formed by joining flat portions of three-dimensionally molded flexible plastic films to obverse surface-side recesses formed on the obverse surface of the horizontal plate portion and reverse surface-side recesses formed on the reverse surface thereof, respectively. Therefore, it is possible to form ink chambers having high sealability.

29 Claims, 17 Drawing Sheets

FOREIGN PATENT DOCUMENTS

| | | | |
|---|---|---|---|
| JP | 61-277460 | A | 12/1986 |
| JP | 05-162333 | A | 6/1993 |
| JP | 05-201019 | A | 8/1993 |
| JP | 10-305591 | A | 11/1998 |
| JP | 11-129488 | A | 5/1999 |
| JP | 2000-296626 | A | 10/2000 |
| JP | 2003-053984 | A | 2/2003 |
| JP | 2003-127411 | A | 5/2003 |

* cited by examiner

LIQUID CONTAINER

CROSS-REFERENCE TO RELATED APPLICATION

This application is a continuation of copending application Ser. No. 10/897,713, filed on Jul. 23, 2004.

BACKGROUND OF THE INVENTION

The present invention relates to a liquid container, and more particularly to a liquid container suitable for use as an ink cartridge having a plurality of ink chambers used for a color ink-jet printer.

As one type of liquid injectors for injecting a liquid onto a target, ink-jet type printers are in widespread use. This ink-jet type printer has a carriage and a recording head mounted on the carriage. The ink-jet type printer is adapted to effect printing with respect to printing paper by discharging ink from a nozzle formed in the recording head while moving the carriage relative to the recording medium. Further, in such an ink-jet type printer, an ink cartridge serving as a liquid container for storing ink is replaceably provided, and the ink discharged from the recording head is adapted to be supplied from the ink cartridge.

Patent document 1 discloses an ink cartridge storing a plurality of ink packs in a case. These ink packs respectively form a plurality of ink chambers. The ink packs are accommodated in the case such that a portion of the ink pack overlaps a portion of an adjacent ink pack, thereby reducing a dead space within the case.

Patent Document 1: JP-A-2003-53984

However, in the case where the plurality of ink packs are accommodated in one case in an overlapping manner as in the ink cartridge of patent document 1, one ink pack is brought into contact with an adjacent ink pack and a pressing action works. Since an ink bag making up the ink pack is formed of a flexible material such as a laminated film, such pressing affects the pressure of the ink accommodated in the ink pack. Accordingly, there is a problem in that a difference arises in the pressure of inks accommodated in the ink packs, i.e., the ink chambers.

Patent document 2 discloses an ink cartridge in which a single ink chamber is formed by attaching flexible plastic films to both sides of a flat rectangular frame made of a plastic plate by a method such as thermal welding. Films made of a soft plastic material are bonded or fused in a slack state to inner peripheral surfaces on both sides of the flat rectangular frame (peripheral walls of a housing) made of a plastic, to thereby form the ink chamber. The films are urged in an outward direction by a compression spring disposed inside this ink chamber to hold the pressure within the ink chamber under a negative pressure.

Patent document 2: JP-A-5-201019

With this ink cartridge, each flexible plastic film at its outer peripheral portion is attached to the rectangular frame in a slack state so that each flexible plastic film can move relative to the rectangular frame as the ink is consumed. A multiplicity of gathers are provided at the outer peripheral edge portion of the flexible plastic film, with the result that faulty sealing is likely to occur at the time of attaching the flexible plastic film to the rectangular frame by thermal welding or the like.

A primary object of the present invention is to provide a liquid container in which a plurality of liquid accommodating chambers formed by flexible films are arranged efficiently.

A secondary object of the present invention is to provide a liquid container which makes it possible to reduce to a low level a pressure difference among liquids accommodated in a plurality of liquid accommodating chambers formed by flexible films.

A tertiary object of the present invention is to provide a liquid container which has a plurality of liquid accommodating chambers air tightly sealed by flexible films.

It should be noted that, in the present invention, a flexible plastic film or a film made of rubber can be suitably used as the flexible film.

SUMMARY OF THE INVENTION

To overcome the above-described problems, in accordance with one aspect of the present invention there is provided a n ink cartridge comprising: a rigid plastic plate; an obverse surface-side ink chamber formed on an obverse surface of the rigid plastic plate; and a reverse surface-side ink chamber formed on a reverse surface of the rigid plastic plate, wherein the obverse surface-side ink chamber is formed by an obverse surface-side recess formed on the obverse surface of the rigid plastic plate and a three-dimensionally molded obverse surface-side flexible plastic film sealing the obverse surface-side recess, and the reverse surface-side ink chamber is formed by a reverse surface-side recess formed on the reverse surface of the rigid plastic plate and a three-dimensionally molded reverse surface-side flexible plastic film sealing the reverse surface-side recess, the obverse surface-side ink chamber and the reverse surface-side ink chamber being formed at positions where at least portions thereof overlap each other with the rigid plastic plate interposed therebetween.

In the ink cartridge in accordance with the present invention, the ink chamber is formed by using a three-dimensionally molded flexible plastic film or film made of rubber. Accordingly, it is possible to secure a necessary volume for storing the ink without needing to slacken the films and attach them to the rigid plastic plate. Therefore, since it is unnecessary to attach the flexible plastic film or rubber-made film to the rigid plastic plate in a state in which gathers are provided at their outer peripheral edge portions, it is possible to reliably seal the film and the rigid plastic plate.

In addition, the ink chambers are formed on the obverse and reverse sides of the rigid plastic plate, respectively, and the ink chambers assume a relationship of layout in which they mutually overlap. Accordingly, as compared with a case where the ink chambers are arranged in a juxtaposed manner, the required space in the planar direction is reduced. Hence, it is possible to realize a short-length ink cartridge having a plurality of ink chambers.

In particular, if an arrangement is adopted in which a plurality of the obverse surface-side ink chambers and a plurality of the reverse surface-side ink chambers are formed, and the obverse surface-side ink chambers and the reverse surface-side ink chambers are arranged so as to be staggered with the rigid plastic plate interposed therebetween, the required space in the planar direction can be made small. For example, if the ink chambers are formed in twos on the obverse and reverse sides, respectively, it is possible to realize a color ink cartridge having a short overall length.

Here, the flexible plastic film or rubber-made film is sufficient if it is three-dimensionally molded so as to be provided with a structure having a protruding portion protruding substantially spherically and a flat portion continuing from an outer peripheral edge of the protruding portion. In this case, it suffices if the flat portions are respectively joined to an obverse surface-side planar surface portion circumscribing the obverse surface-side recess of the rigid plastic plate and a reverse surface-side planar surface portion circumscribing the reverse surface-side recess thereof. Since it is sufficient to mutually fuse the flat portion of the flexible plastic film or rubber-made film and the flat portion of the rigid plastic plate, it is possible to reliably seal them.

Next, through holes for removing ink stored in the ink chambers may be respectively formed in the obverse surface-side recess and the reverse surface-side recess.

In addition, to protect the flexible plastic film or rubber-made film forming each ink chamber and to ensure the gas barrier properties and moisture barrier properties of each ink chamber, it suffices if the rigid plastic plate with the ink chambers formed thereon is accommodated in a cartridge case having the required barrier properties.

In this case, if a waste-ink collecting chamber is formed for collecting waste ink by making use of an empty space inside the cartridge case, it is possible to collect the waste ink without causing an increase in the size of the ink cartridge, so that it is preferable.

In accordance with another aspect of the present invention there is provided a liquid container comprising: a base defining a first recess, a second recess separated from the first recess, a first planar surface circumscribing a peripheral edge of an opening of the first recess, and a second planar surface circumscribing a peripheral edge of an opening of the first recess; at least one flexible film sealingly attached to the first and second planar surfaces; a first port disposed in the base, and in fluid communication with the first recess; and a second port disposed in the base, and in fluid communication with the second recess.

A plurality of chambers can be efficiently formed by forming a plurality of recesses on a single base and by making use of these recesses and at least one flexible film.

In addition, since the first recess and the second recess are separated from each other through the base, a liquid accommodated in the chamber formed by the first recess and a liquid accommodated in the chamber formed by the second recess are separated through the base. Accordingly, the transmission of pressure between the liquids accommodated in these chambers can be prevented by the base.

In addition, since the at least one flexible film is attached to the first and second planar surfaces, it is possible to improve the airtightness between the flexible film and the base. In particular, in a case where the flexible film is attached to the first and second planar surfaces by thermal welding, it is possible to easily and reliably ensure the airtightness between the flexible film and the base.

Furthermore, since the base has the first and second ports respectively communicating with the first and second recesses, fluid paths leading from the respective chambers to the first and second ports can be formed by attaching the first and second flexible films to the base.

As for this liquid container, it is possible to adopt an arrangement in which the first and second planar surfaces lie in the same plane, and at least one flexible film includes a single flexible film attached to both of the first and second planar surfaces. A plurality of chambers can be formed by attaching a single film to the base.

In this case, preferably, the single flexible film has first and second collapsible portions corresponding to the first and second recesses, and a planar surface portion circumscribing the first and second collapsible portions, the planar surface portion having a boundary between the first and second collapsible portions. Such a flexible film can be easily fabricated by three-dimensional molding.

As for this liquid container, it is possible to adopt an arrangement in which the at least one flexible film includes discrete first and second flexible films, the first flexible film being attached to the first planar surface, and the second flexible film being attached to the second planar surface. This arrangement is effective in a case where the first and second planar surfaces are not disposed in the same plane, or the first and second planar surfaces are discontinuous. For example, this arrangement is effective in a case where the first recess is formed on the obverse surface side of the base, and the second recess is formed on the reverse surface side of the base.

In this case, each of the first and second flexible films should preferably have a collapsible portion and a planar surface portion circumscribing the collapsible portion. Such a flexible film can be easily fabricated by three-dimensional molding.

In this liquid container, the first recess can be formed on a first side of the base, and the second recess can be formed on a second side of the base opposite the first side. Since the plurality of chambers are separated from each other by means of the base, it is possible to reliably prevent the pressure of the liquid accommodated in one chamber from affecting the pressure of the liquid accommodated in another chamber.

Furthermore, in this case, since the first and second recesses can be respectively disposed on the first side and the second side of the base such that the first recess and the second recess partially overlap, the degree of freedom in design increases for arranging the plurality of chambers with high space efficiency.

In this liquid container, the first and second recesses may be disposed on the same side of the base. Namely, the first and second recesses may be disposed on the same side of the base to arrange the plurality of chambers with high space efficiency.

In this liquid container, preferably, the first and second parts communicate with the first and second recesses through first and second fluid paths that are open at bottoms of the first and second recesses, respectively. As the liquid is consumed, the flexible film approaches the bottom of the recess, and when all the liquid has been consumed, the flexible film comes into contact with the bottom of the recess. Accordingly, as the fluid path is made open at the bottom, the liquid accommodated in the chamber can be consumed until the flexible film comes into contact with the bottom. Accordingly, it is possible to use all the liquid without leading the liquid in the liquid container.

It should be noted that each of the first and second ports may be used for allowing the liquid accommodated in the chamber formed by the recess and the film to flow to the outside, or for allowing the liquid to flow from the outside into the chamber formed by the recess and the film.

The present invention relates to the subject matter contained in Japanese patent application No. 2003-201887 (filed on Jul. 25, 2003), which is expressly incorporated herein by reference in its entirety.

DESCRIPTION OF THE PREFERRED EMBODIMENT

Figure 1:
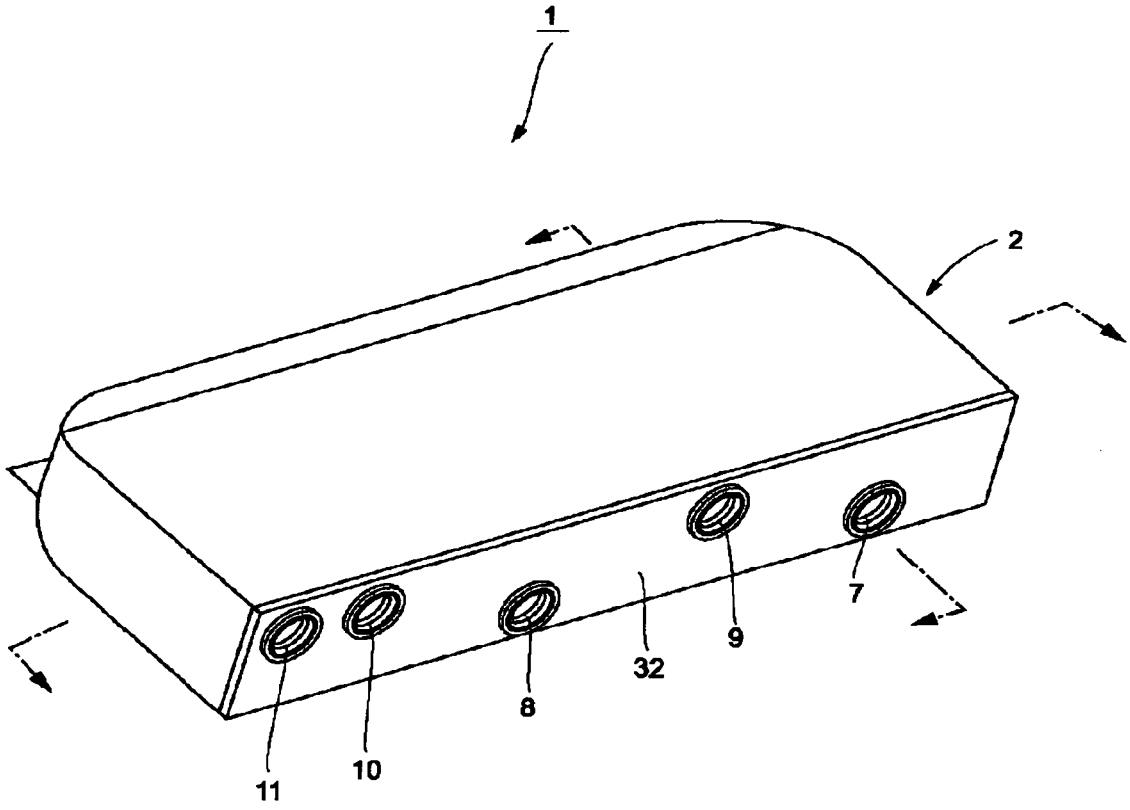
FIG. 1 is an external perspective view illustrating a multi-color-use ink cartridge to which the invention is applied.
Figure 2:
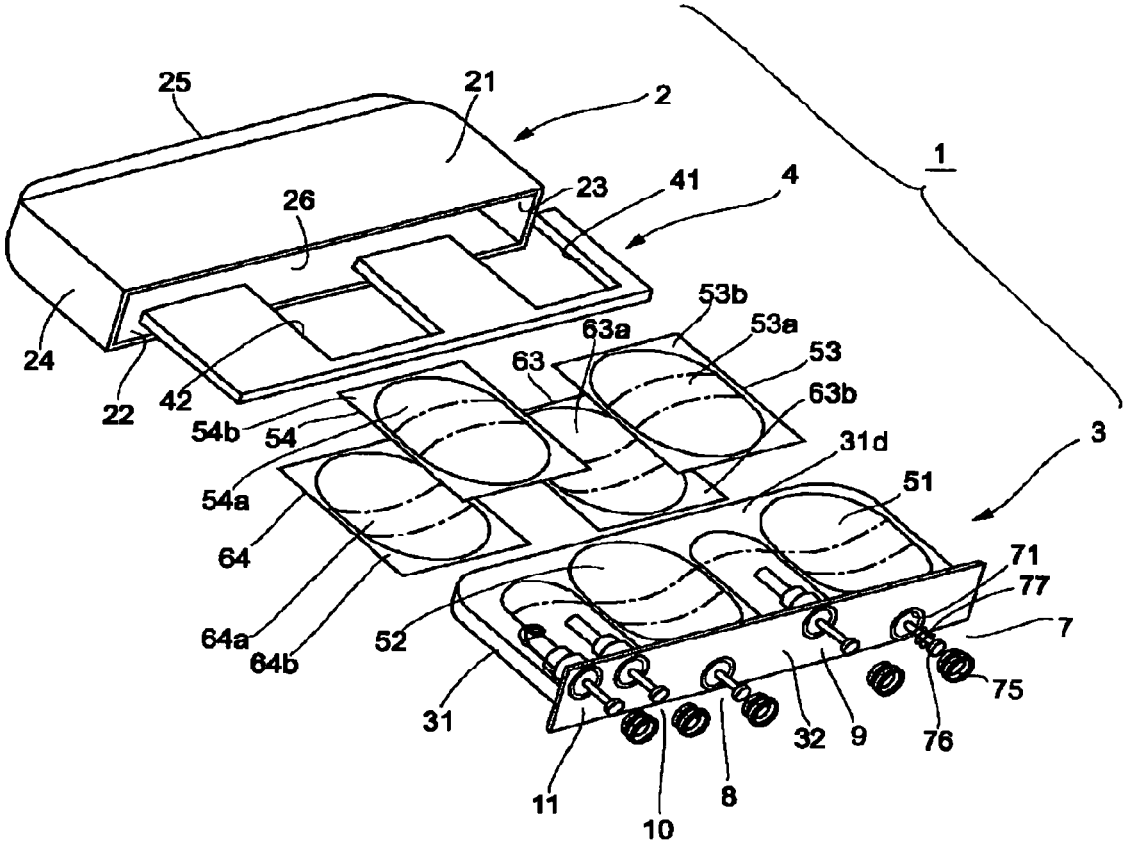
FIG. 2 is an exploded perspective view of the ink cartridge shown in FIG. 1.
Figure 3:
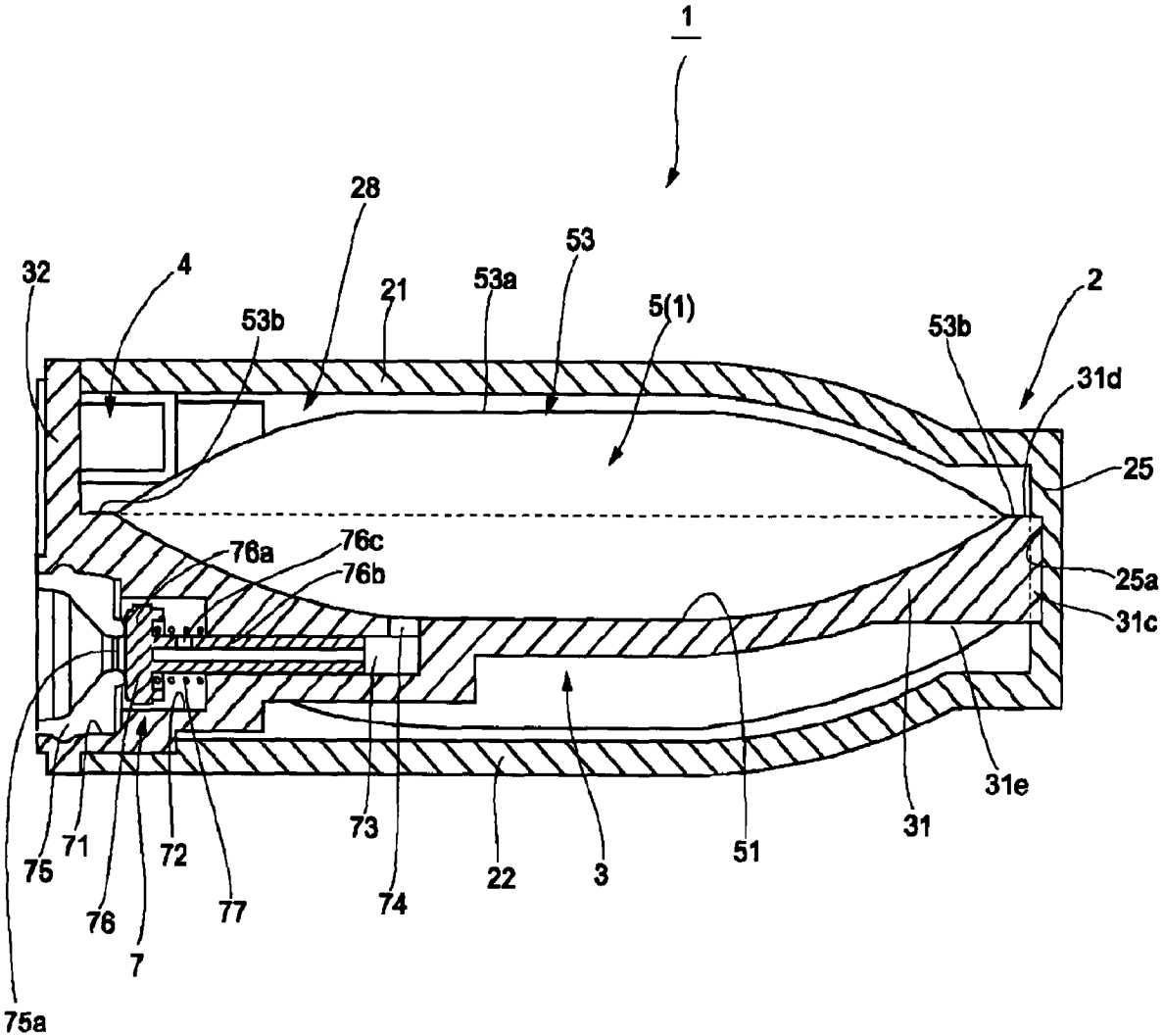
FIG. 3 is a transverse cross-sectional view of the ink cartridge shown in FIG. 1.
Figure 4:
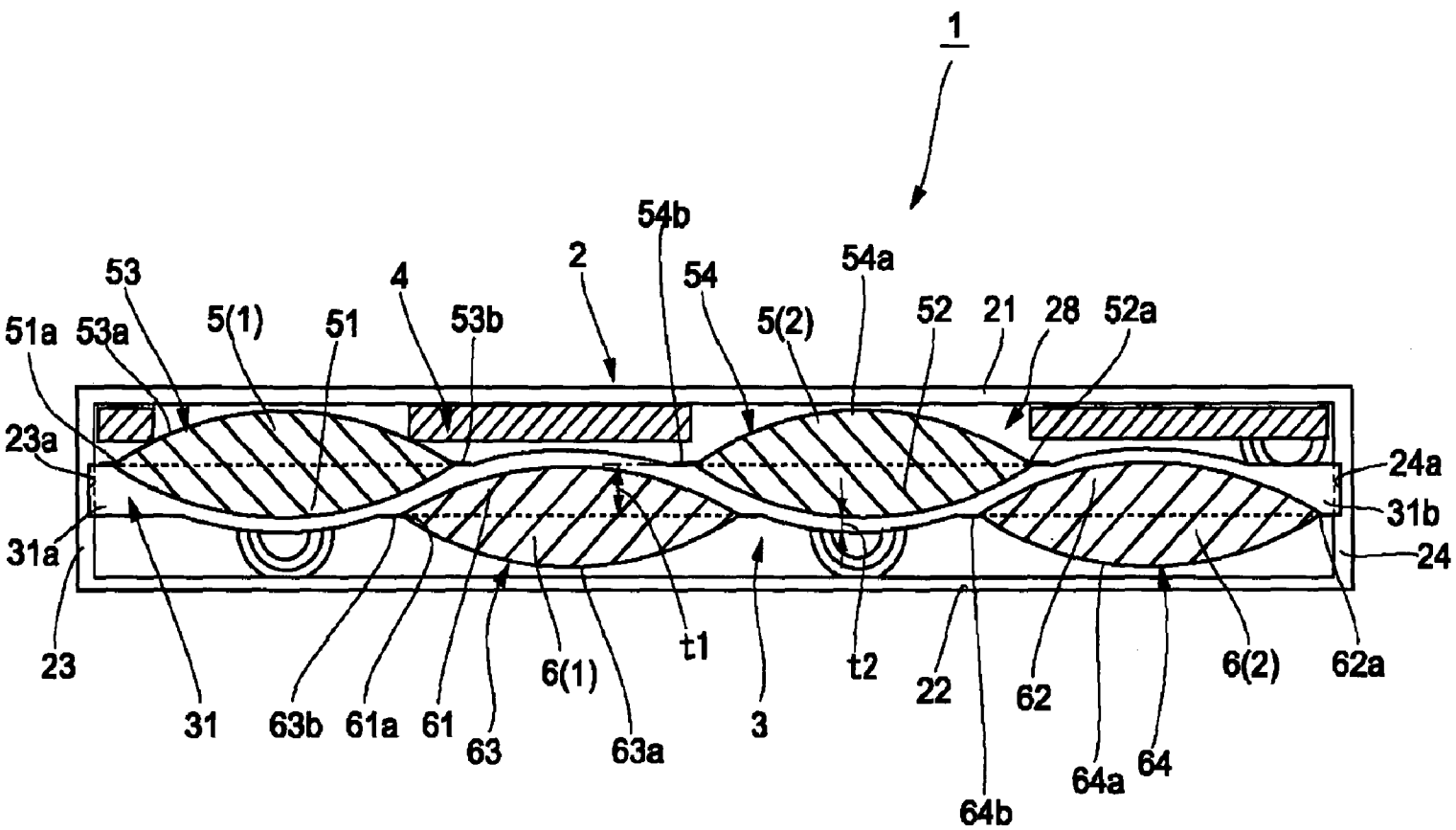
FIG. 4 is a longitudinal cross-sectional view of the ink cartridge shown in FIG. 1.
Figure 5:
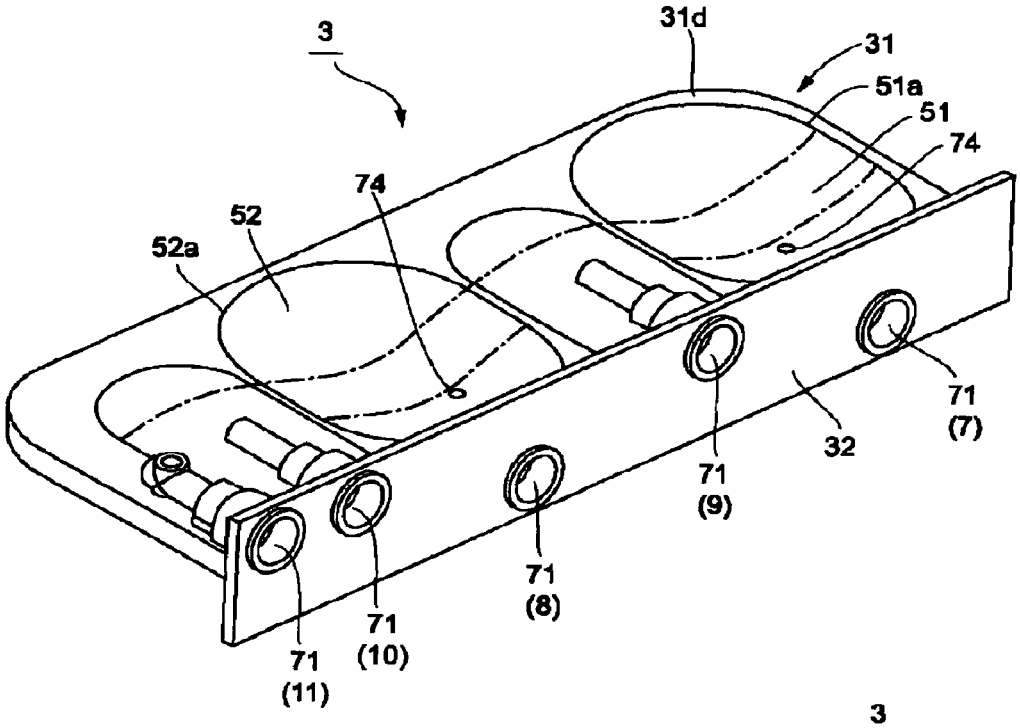
FIG. 5 is a perspective view of a rigid plastic plate of the ink cartridge shown in FIG. 1.
Figure 5:
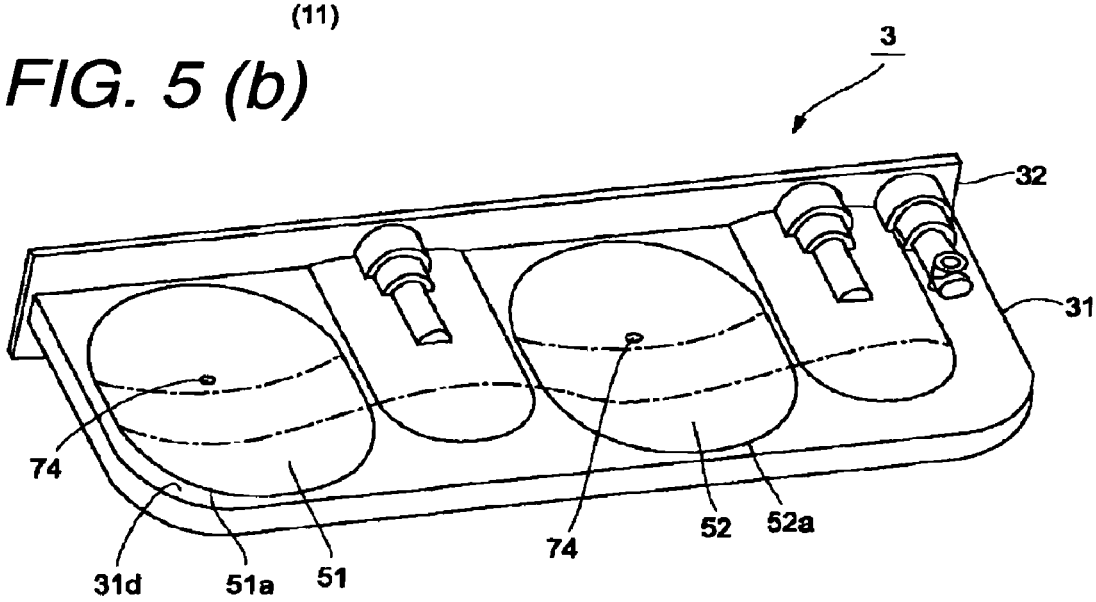

Referring now to the appended drawings, a description will be given of an embodiment of an ink cartridge to which the present invention is applied as a liquid container. FIG. 1 is an external perspective view illustrating a multicolor-use ink cartridge in accordance with this embodiment; FIG. 2 is an exploded perspective view thereof; FIG. 3 is a transverse cross-sectional view thereof; FIG. 4 is a longitudinal cross-sectional view thereof; and FIG. 5 is a perspective view of a rigid plastic plate.

An ink cartridge 1 includes a cartridge case 2 made of a plastic, as well as a rigid plastic plate 3 and a waste ink absorbent 4 which are accommodated in this cartridge case 2. Two obverse surface-side ink chambers 5(1) and 5(2) and two reverse surface-side ink chambers 6(1) and 6(2) are respectively formed on obverse and reverse surfaces of the rigid plastic plate 3. For example, color inks of black and cyan are respectively stored in the obverse surface-side ink chambers 5(1) and 5(2), and color inks of magenta and yellow are stored in the reverse surface-side ink chambers 6(1) and 6(2). In this embodiment, the plastic plate 3 functions as a base.

The cartridge case 2 has the shape of a flat sideways elongated rectangular parallelepiped, and has an upper plate portion 21, a lower plate portion 22, left and right side plate portions 23 and 24, and a rear-end end plate portion 25. A sideways elongated rectangular opening 26 is formed in its front side end face. Insertion grooves 23*a*, 24*a*, and 25*a* for the rigid plastic plate 3 are respectively formed in inner surfaces of the side plate portions 23 and 24 and the end plate portion 25 (see FIGS. 3 and 4). This cartridge case 2 is formed of a plastic material having barrier properties against gas and steam.

The rigid plastic plate 3 has a horizontal plate portion 31 inserted in the cartridge case 2, as well as a front plate portion 32 attached orthogonally to a front end of the horizontal plate portion 31. The front plate portion 32 has a rectangular shape identical to a contour of the front end of the cartridge case 2, and is bonded to respective front end faces of the upper plate portion 21, the lower plate portion 22, and the left and right side plate portions 23 and 24 defining the rectangular opening 26. The rectangular opening 26 of the cartridge case 2 is thereby sealed. Formed in this front plate portion 32 are ink supply ports 7 to 10 for supplying the inks respectively stored in the obverse surface-side ink chambers 5(1) and 5(2) and the reverse surface-side ink chambers 6(1) and 6(2) to the outside (ink-jet head side). Further, a waste-ink collection port 11 is also formed for collecting waste inks.

The horizontal plate portion 31 of the rigid plastic plate 3 is inserted in the cartridge case 2 in a state in which its left and right side end portions 31*a* and 31*b* and a rear end portion 31*c* are inserted in the insertion grooves 23*a*, 24*a*, and 25*a* of the cartridge case 2. Two obverse surface-side recesses 51 and 52 are formed on an obverse surface 31*d* of this horizontal plate portion 31, and two reverse surface-side recesses 61 and 62 are also formed on a reverse surface 31*e* thereof. In this embodiment, these recesses 51, 52, 61, and 62 have identical shapes, and are curved substantially spherically from inner peripheral edges 51*a*, 52*a*, 61*a*, and 62*a* having elliptical shapes elongated in a back-and-forth direction. It should be noted that, in FIGS. 2 and 5, curved states are indicated by chain lines so that the curved states can be readily understood.

As shown in FIG. 4, the depth of the respective recesses 51, 52, 61, and 62 is substantially identical to the thickness t1 of the horizontal plate portion 31. In addition, the thickness t2 of portions where these recesses 51, 52, 61, and 62 are formed is small, and these portions project vertically from the obverse surface and the reverse surface of the plate body portion 31 by the portion of their thickness t2.

The obverse surface-side recesses 51 and 52 are covered with three-dimensionally molded obverse surface-side flexible plastic films 53 and 54, to thereby form the obverse surface-side ink chambers 5(1) and 5(2), respectively. Similarly, the reverse surface-side recesses 61 and 62 are also covered with three-dimensionally molded reverse surface-side flexible plastic films 63 and 64, to thereby form the reverse surface-side ink chambers 6(1) and 6(2), respectively.

In this embodiment, these plastic films 53 and 54 as well as 63 and 64 have identical shapes. Namely, these plastic films 53 and 54 as well as 63 and 64 have protruding portions 53*a*, 54*a*, 63*a*, and 64*a* which protrude substantially spherically, as well as flat portions 53*b*, 54*b*, 63*b*, and 64*b* circumscribing their elliptical outer peripheral edges. Contour shapes of the flat portions 53*b*, 54*b*, 63*b*, and 64*b* are formed in rectangular shapes which are elongated in the back-and-forth direction. Further, the protruding portions 53*a*, 54*a*, 63*a*, and 64*a* have shapes symmetrical with respect to the planes of the recesses 51, 52, 61, and 62 formed on the horizontal plate portion 31. Such three-dimensional flexible plastic films 53 and 54 can be obtained by, for example, vacuum molding plastic films.

As for the thus three-dimensionally molded obverse surface-side flexible plastic films 53 and 54, their flat portions 53*b* and 54*b* are joined to those portions of the horizontal plate portion 31 that form planar surfaces and are portions of the obverse surface 31*d* circumscribing the obverse surface-side recesses 51 and 52 by ultrasonic welding, thermal welding, an adhesive agent, or the like, thereby forming liquid-tight sealed portions. Similarly, as for the reverse surface-side flexible plastic films 63 and 64 as well, their flat portions 63*b* and 64*b* are also sealed to those portions of the horizontal plate portion 31 that form planar surfaces and are portions of the reverse surface 31*e* circumscribing the reverse surface-side recesses 61 and 62.

It should be noted that the deformation pressure (back pressure) of the flexible plastic film can be controlled by the thickness of the film, but control of deformation pressure with higher accuracy becomes possible by providing ribs on the film surface during the three-dimensional molding of the film.

It should be noted that a film made of rubber may be used instead of the flexible plastic films 53 and 54. In this case, the value of the film thickness should preferably be set in the range of 200 microns to 1.5 mm.

Here, as can be well appreciated from FIG. 4, the obverse surface-side ink chambers 5(1) and 5(2) and the reverse surface-side ink chambers 6(1) and 6(2) are arranged in the breadthwise direction of the ink cartridge 1 so as to be staggered with the horizontal plate portion 31 of the rigid plastic plate 3 interposed therebetween. Further, the obverse surface-side ink chambers 5(1) and 5(2) and the reverse surface-side ink chambers 6(1) and 6(2) are set in such a relation of layout as to partially overlap each other with the horizontal plate portion 31 interposed therebetween. For example, both sides of the obverse surface-side ink chamber 5(2) overlaps the reverse surface-side ink chambers 6(1) and 6(2), which are adjacent thereto at left and right on the reverse surface side, in the breadthwise direction by approximately ¼ of the breadth of the ink chamber. Similarly, both sides of the reverse surface-side ink chamber 6(1) overlaps the obverse surface-side ink chambers 5(1) and 5(2), which are adjacent thereto at left and right on the obverse surface side, in the breadthwise direction by approximately ¼ of the breadth of the ink chamber.

Next, a description will be given of structures the ink supply ports 7 to 10 of the respective ink chambers 5(1), 5(2), 6(1), and 6(2). Since these ink chambers are identical, a description will be given of the ink supply port 7 of the obverse surface-side ink chamber 5(1) by referring mainly to FIG. 3, and a description of the other ink supply ports 8 to 10 will be omitted. The ink supply port 7 has a circular hole 71 which is formed in such a manner as to extend from the front plate portion 32 of the rigid plastic plate 3 to the horizontal plate portion 31. A small-diameter circular hole 72 is formed continuing from a bottom of this circular hole 71 coaxially therewith. Further, a smaller-diameter circular ink path 73 is formed continuing from a bottom of this small-diameter circular hole 72 coaxially therewith. An end of this ink path 73 communicates with an ink removal port 74 extending vertically. The ink removal port 74 is open to the obverse surface-side recess 51 and communicates with the obverse surface-side ink chamber 5(1).

An annular seal rubber 75 is fitted to the circular hole 71 in a liquid-tight state, and a valve 76 fitted in the small-diameter circular hole 72 is disposed on the rear surface side of the seal rubber 75. The valve 76 has a valve body 76*a* pressed against an end face of the seal rubber 75, as well as a hollow shaft 76*b* extending coaxially from a rear surface of the valve body 76*a*. The hollow shaft 76*b* is inserted in the ink path 73 in a slidable state. An ink hole 76*c* is formed in a proximal portion of the valve body 76*a* in the hollow shaft 76*b*, and the hollow portion of the hollow shaft 76*b* communicates with the circular hole 72 through this portion. The valve 76 is constantly pressed against the seal rubber 75 side by means of a valve spring 77, and an ink supply hole 75*a* formed in the center of the seal rubber 75 is sealed by that valve body 76*a*. If an ink supply needle (not shown) is inserted in the ink supply hole 75*a* from the outside, the valve 76 is pressed open, and the circular hole 72 communicates with the ink supply hole 75*a*, thereby allowing the ink to be supplied from the ink chamber 5(1) side to the ink supply needle inserted therein.

In this embodiment, since the obverse surface-side ink chambers 5(1) and 5(2) and the reverse surface-side ink chambers 6(1) and 6(2) are arranged in the staggered manner with the horizontal plate portion 31 of the rigid plastic plate 3 interposed therebetween, the ink supply ports 7 to 10 are also arranged in the staggered manner correspondingly.

Next, the waste ink absorbent 4 is inserted in an upper partitioned portion 28 of the interior of the cartridge case 2 partitioned into upper and lower portions by the horizontal plate portion 31 of the rigid plastic plate 3. This portioned portion 28 functions as a waste-ink collecting chamber. As can be appreciated from FIG. 2, rectangular notches 41 and 42 are formed in the waste ink absorbent 4 so as not to interfere with the protruding portions 53*a* and 54*a* of the obverse surface-side flexible plastic films 53 and 54 making up the obverse surface-side ink chambers 5(1) and 5(2). The waste-ink collection port 11 is formed at an end of the front plate portion 32 of the rigid plastic plate 3 in such a manner as to be adjacent to the ink supply port 10 of the reverse surface-side ink chamber 6(2). The structure of this waste-ink collection port 11 is similar to those of the ink supply ports 7 to 10. If a needle for waste ink collection is inserted in it, that waste-ink collection port 11 opens, and it becomes possible to absorb the waste ink by means of the waste ink absorbent 4. It should be noted that the partitioned portion 28 is open to the atmosphere through an atmosphere communication hole (not shown) formed in the cartridge case 2 to allow the waste ink to be absorbed by the waste ink absorbent 4.

In addition, a plurality of atmosphere communication holes may be formed in the cartridge case 2 to allow the atmospheric pressure to be applied to the inks accommodated in the obverse surface-side ink chambers 5(1) and 5(2) and the reverse surface-side ink chambers 6(1) and 6(2).

As described above, in the ink cartridge 1, the two obverse surface-side ink chambers 5(1) and 5(2) and the two reverse surface-side ink chambers 6(1) and 6(2) are respectively formed on the obverse surface and the reverse surface of the horizontal plate portion 31 of the rigid plastic plate 3. The respective ink chambers 5(1), 5(2), 6(1), and 6(2) are formed by covering and sealing the obverse surface-side recesses 51 and 52 and the reverse surface-side recesses 61 and 62 formed on the obverse and reverse surfaces of the horizontal plate portion 31 of the rigid plastic plate 3 with the three-dimensionally molded obverse surface-side flexible plastic films 53 and 54 and reverse surface-side flexible plastic films 63 and 64. In addition, these ink chambers 5(1), 5(2), 6(1), and 6(2) are arranged in the breadthwise direction of the ink cartridge 1 so as to be staggered in a mutually overlapping state with the horizontal plate portion 31 interposed therebetween.

In the state in which the inks are filled in the respective ink chambers 5(1), 5(2), 6(1), and 6(2), the respective flexible plastic films 53, 54, 63, and 64 are held in the three-dimensionally molded state. As the inks are consumed, the protruding portions 53*a* to 64*a* of the flexible plastic films 53, 54, 63, and 64 deflate, and the volumes of the ink chambers decrease. Accordingly, these ink chambers function in the same way as the conventional ink chambers which are constructed by joining plastic films in a slack state to a rigid plastic plate.

In the ink cartridge 1 in accordance with this embodiment, since the three-dimensionally molded flexible plastic films 53, 54, 63, and 64 are used, it suffices if the flat portions 53*b* to 64*b* circumscribing the outer peripheral edges of their protruding portions 53*a* to 64*a* are sealed by being joined to the planar surface portions of the obverse surface 31*d* and the reverse surface 31*e* of the horizontal plate portion 31 of the rigid plastic plate 3. Accordingly, it is sufficient to join the flat portions of the plastic films to the planar surface portions of the rigid plastic plate, unlike the case in which the ink chambers are formed by shirring outer peripheral edge portions of the plastic films and joining them to the surface of the rigid plastic plate, such that as the inks are consumed, the plastic films move in the out-of-plane direction to reduce the volumes of the ink chambers. Therefore, it is possible to reliably seal the flat portions of the plastic films to the planar surface portions of the rigid plastic plate.

In addition, since the ink chambers 5(1), 5(2), 6(1), and 6(2) are arranged so as to be staggered in a mutually overlapping state with the horizontal plate portion 31 interposed therebetween, the breadthwise dimension of the ink cartridge 1 can be made small. Accordingly, the liquid container in accordance with this embodiment is very useful in rendering compact the multicolor-use ink cartridge in which the plurality of ink chambers need to be formed.

Other Embodiments

Although a description has been given of the case where the invention is applied to the multicolor-use ink cartridge, the invention is similarly applicable to a monochrome-use ink cartridge having a plurality of ink chambers. Further, the number of the ink chambers is not limited to the above-described example, and may be two or three, or five or more.

Furthermore, the shapes of the obverse surface-side recesses and the reverse surface-side recesses formed on the rigid plastic plate are not limited to the above-described example, and it is possible to adopt other shapes such as shallow circular recesses. Similarly, the shapes of the protruding portions of the three-dimensionally molded flexible plastic films are not limited to the above-described example, and it is possible to adopt other shapes such as a flat pyramidal shape, a prismatic shape, or the like.

As a first modification, FIGS. 6 to 9 show an ink cartridge which has two ink chambers and each of them is formed by a prismatic recess and a prismatic flexible film. The first modification will be described later in detail.

Furthermore, although the obverse surface-side recesses and the reverse surface-side recesses are formed in the same shapes, they may be formed in different shapes. Similarly, although the obverse surface-side flexible plastic films and the reverse surface-side flexible plastic films are formed in the same shapes, they may be formed in different shapes. If these parts are formed in the same shapes, there is an advantage in that the parts can be made common. In cases such as where the ink chamber for the black ink whose quantity consumed is large is provided with a large volume in comparison with the other ink chambers, if a flexible plastic film is used in which a protruding portion of a large size in comparison with the other ink chambers is formed, it is possible to simply construct a large-volume ink chamber.

As a second modification, FIGS. 10 to 14 show an ink cartridge in which flexible films of different shapes are used. The second modification will be described later in detail.

Furthermore, although a plurality of ink chambers are formed by the obverse surface-side recesses and the reverse surface-side recesses, a plurality of ink chambers may be formed by a plurality of obverse surface-side recesses or a plurality of reverse surface-side recesses.

Figure 15:
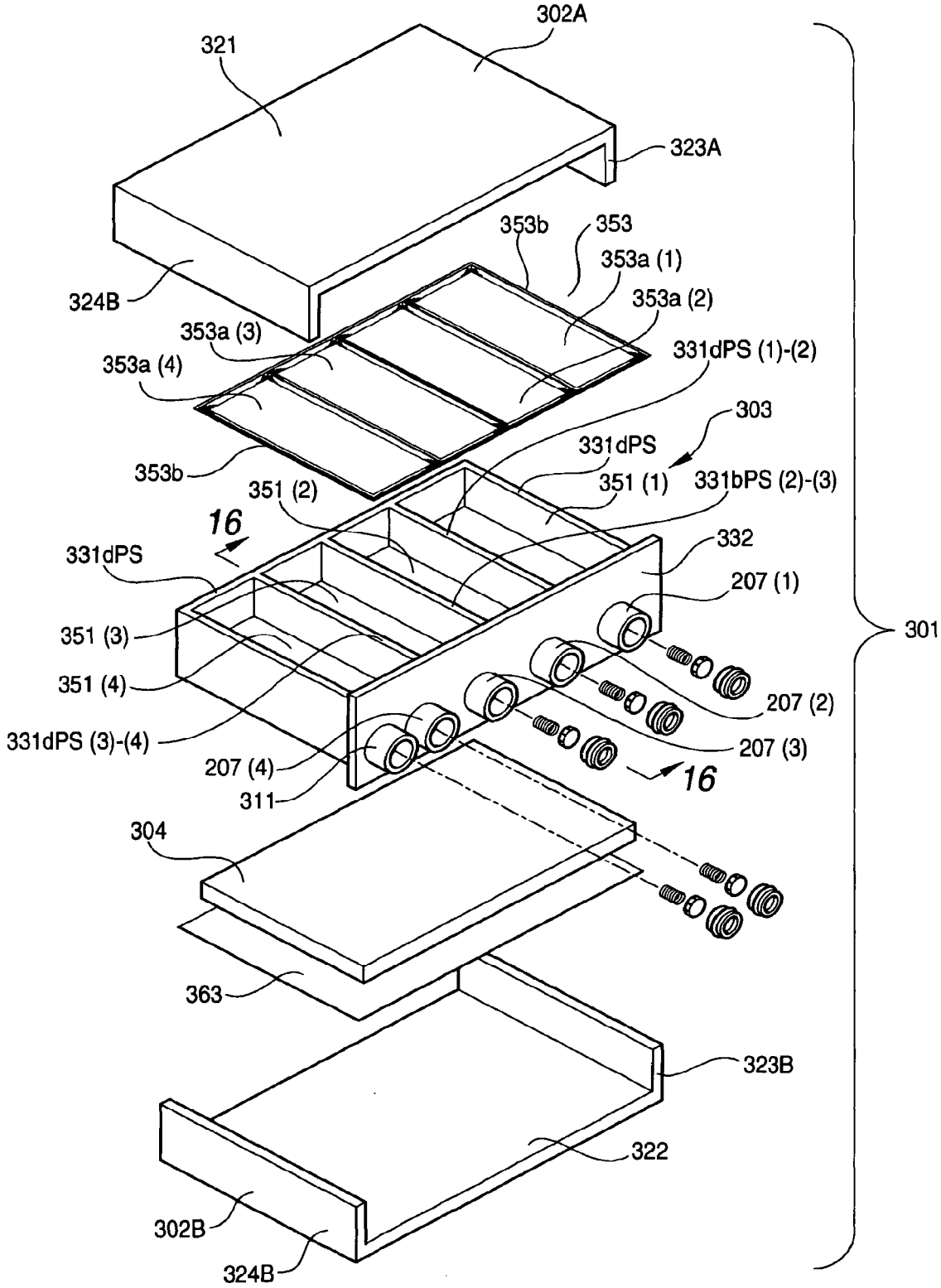
FIG. 15 is an exploded perspective view of an ink cartridge in accordance with a third modification.
Figure 16:
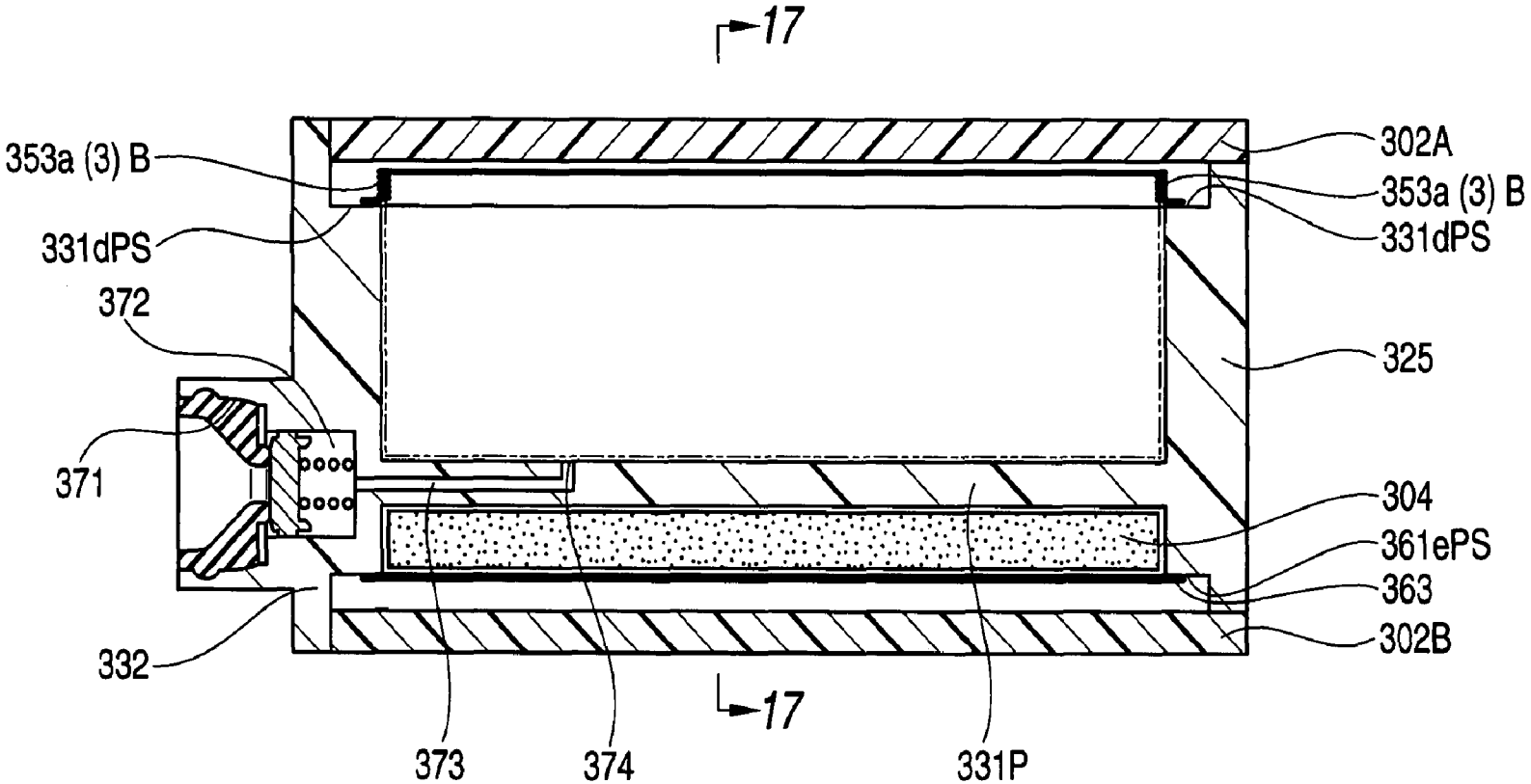
FIG. 16 is a transverse cross-sectional view, taken along line 16-16 in FIG. 15, of the ink cartridge.
Figure 17:
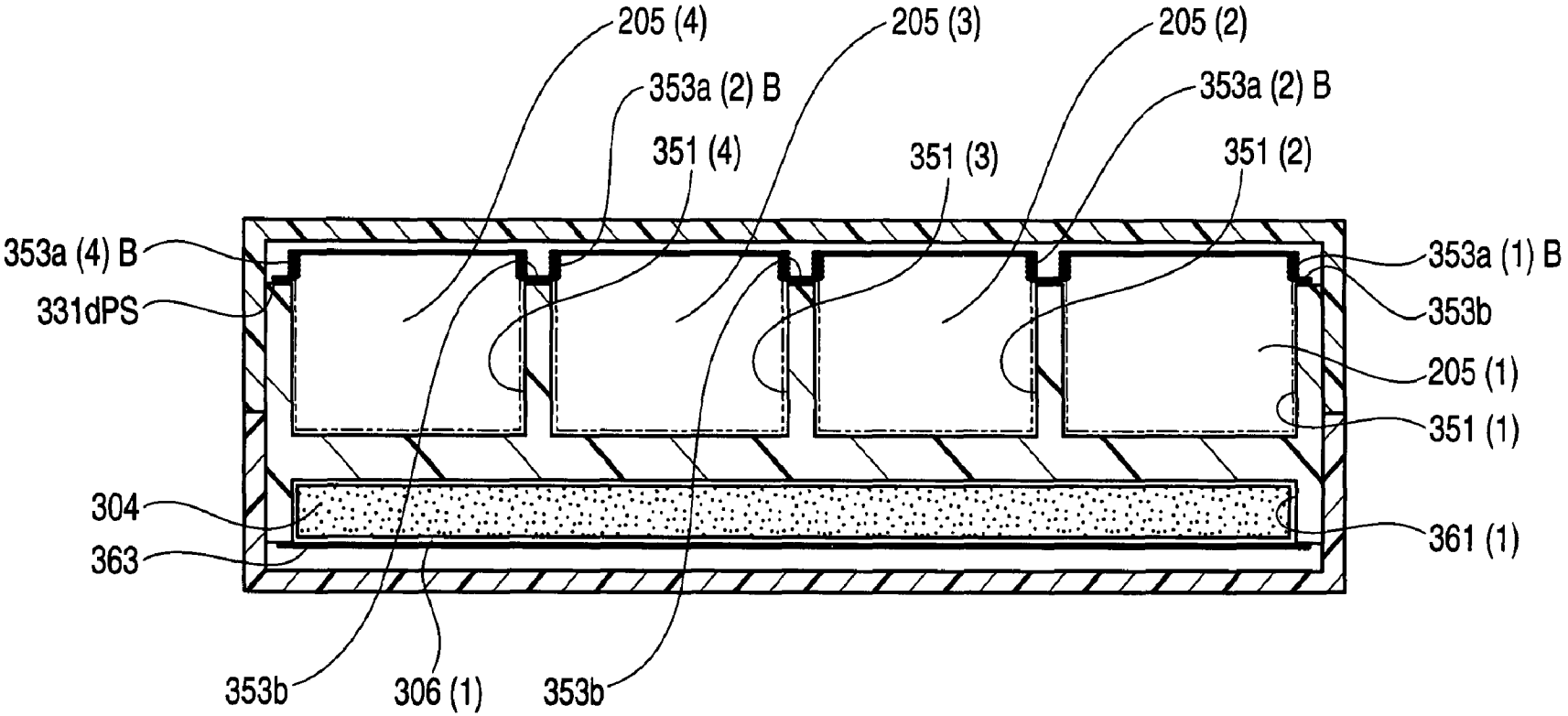
FIG. 17 is a cross-sectional view taken along line 17-17 in FIG. 16.

As a third modification, FIGS. 15 to 17 show an ink cartridge in which a plurality of ink chambers are formed by a plurality of obverse surface-side recesses. The third modification will be described later in detail.

First Modification

Figure 6:
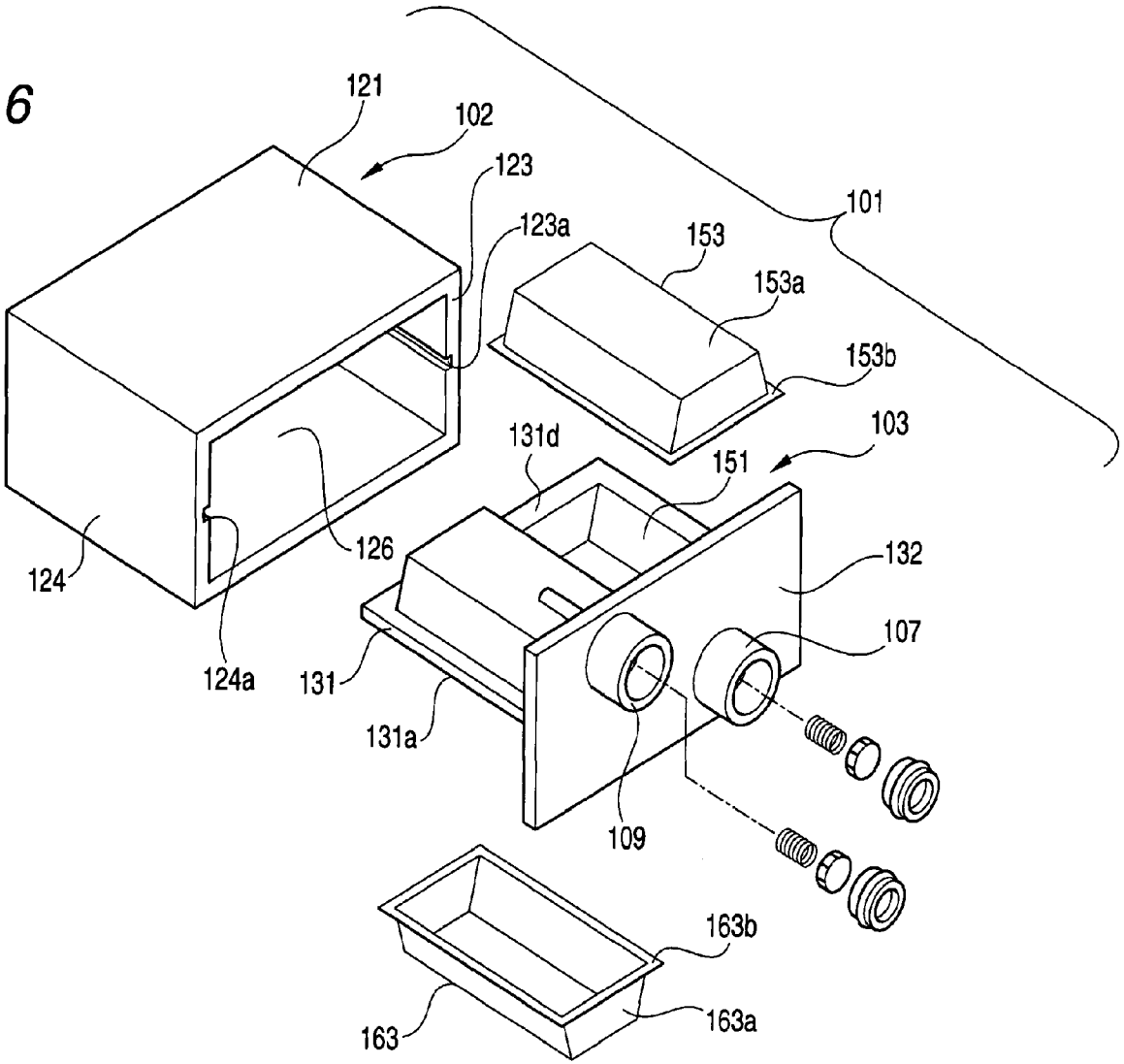
FIG. 6 is an exploded perspective view of an ink cartridge in accordance with a first modification.
Figure 7:
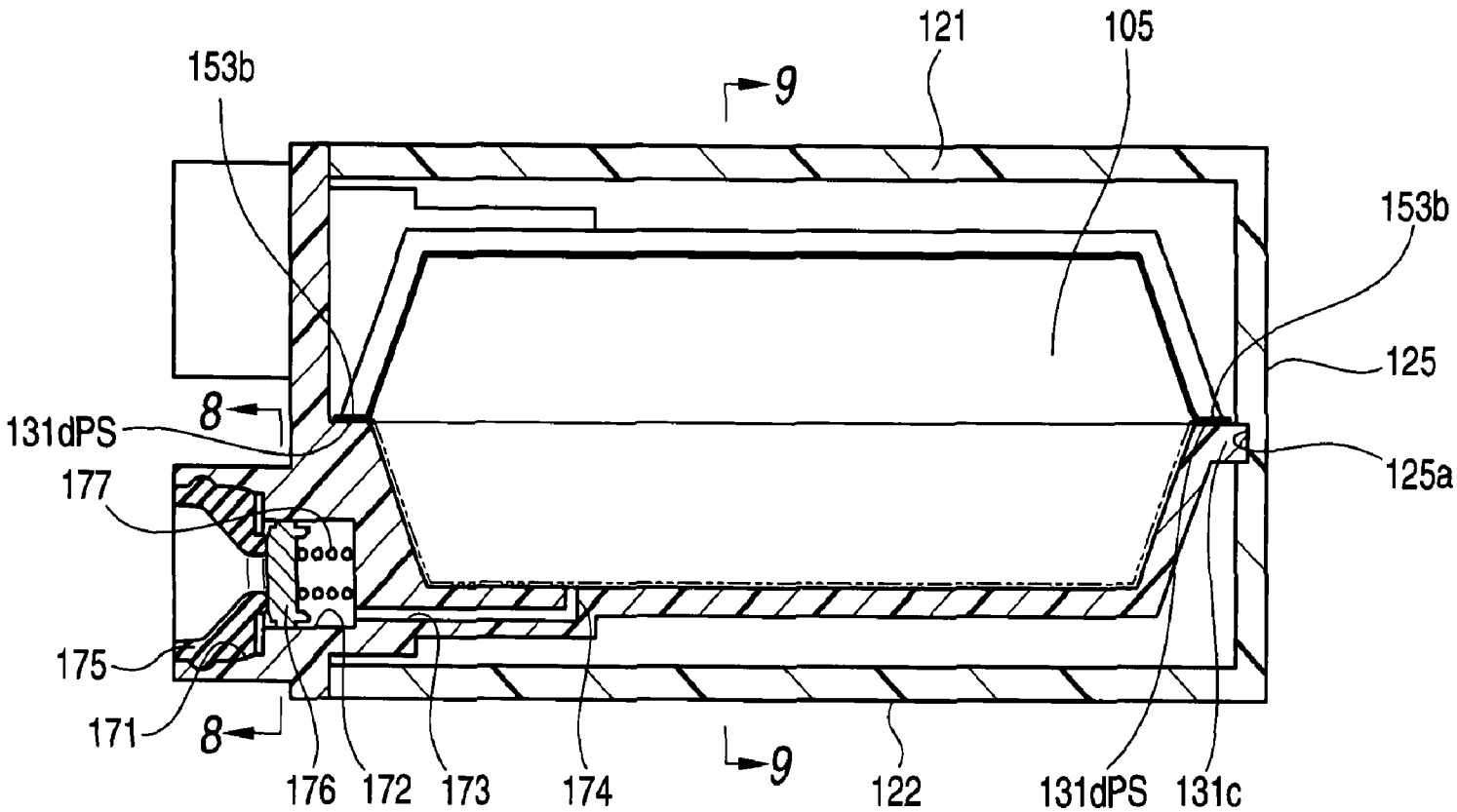
FIG. 7 is a transverse cross-sectional view of the ink cartridge in accordance with the first modification.
Figure 8:
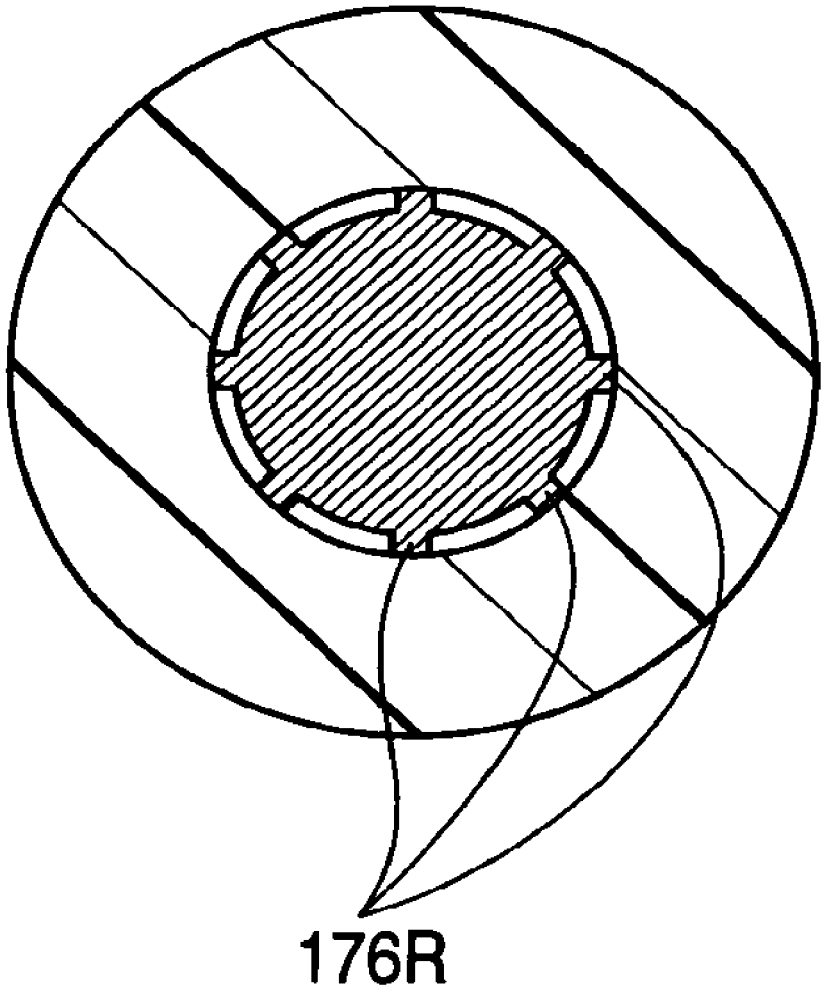
FIG. 8 is a cross-sectional view taken along line 8-8 in FIG. 7.
Figure 9:
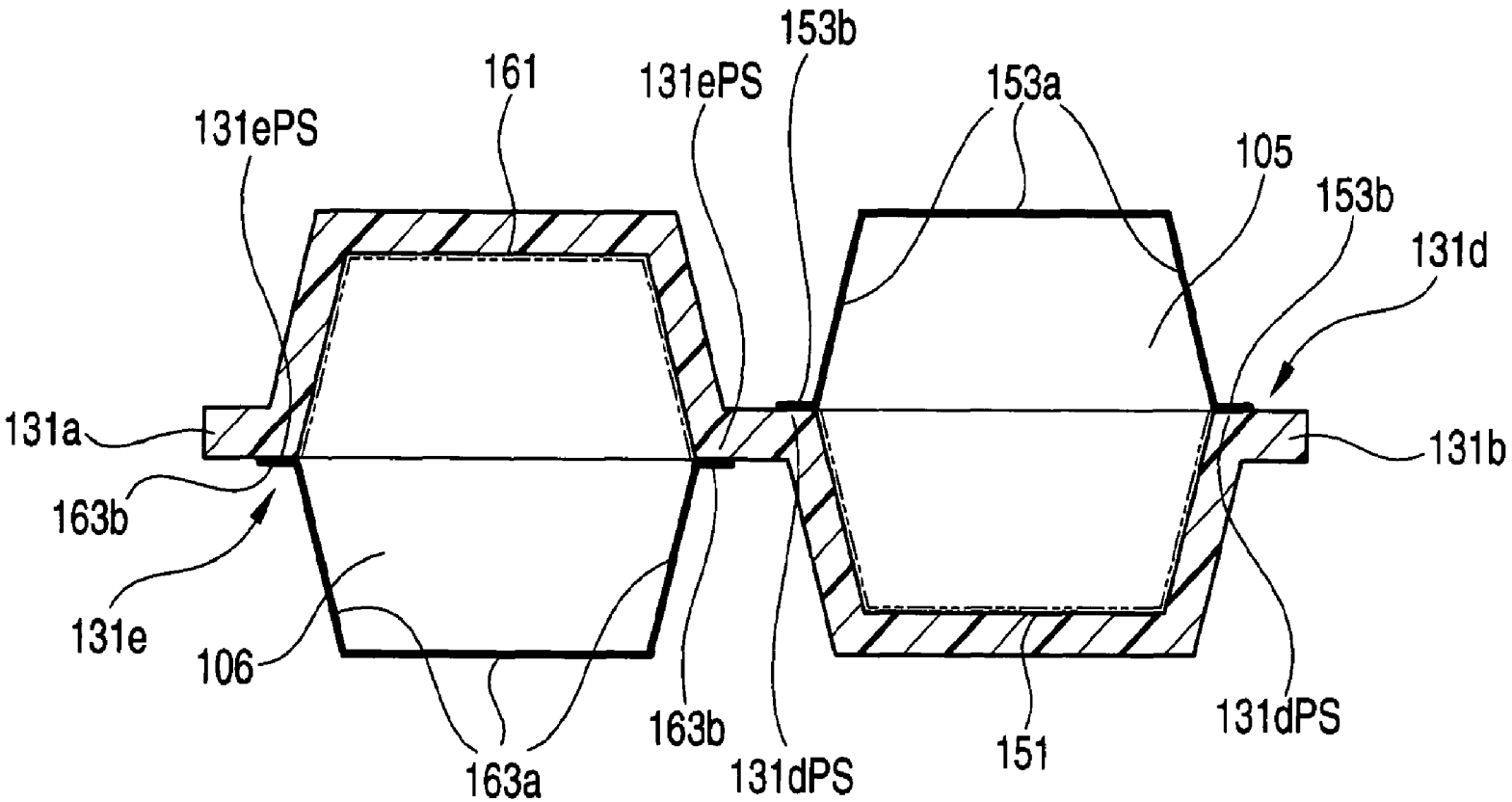
FIG. 9 is a cross-sectional view taken along line 9-9 in FIG. 7.

FIGS. 6 to 9 show an ink cartridge 101 in accordance with the first modification. FIG. 6 is an exploded perspective view of the ink cartridge 101; FIG. 7 is a transverse cross-sectional view of the ink cartridge 101; FIG. 8 is a cross-sectional view taken along line 8-8 in FIG. 7; and FIG. 9 is a cross-sectional view taken along line 9-9 in FIG. 7.

The ink cartridge 101 has a cartridge case 102 and a base 103 accommodated in this cartridge case 102. An obverse surface-side ink chamber 105 and a reverse surface-side ink chamber 106 are formed in the ink cartridge 101 (see FIG. 9). Although the ink cartridge 101 in accordance with the first embodiment does not have the waste ink absorbent and the waste ink collection port, they may be added. In addition, the waste ink absorbent may be disposed in the interior of one of the obverse surface-side ink chamber 105 and the reverse surface-side ink chamber 106 so as to function as a waste ink chamber.

The cartridge case 102 has an upper plate portion 121, a lower plate portion 122, left and right side plate portions 123 and 124, and a rear-end end plate portion 125. Side end portions 131*a* and 131*b* and a rear end portion 131*c* of a horizontal plate portion 131 of the base 103 are inserted and held in insertion grooves 123*a*, 124*a*, and 125*a*. An opening 126 of the cartridge case 102 is sealed by a front plate portion 132 of the base 103.

This front plate portion 132 has ink supply ports 107 and 109 respectively communicating with the obverse surface-side ink chamber 105 and the reverse surface-side ink chamber 106.

The horizontal plate portion 131 of the base 3 is inserted in the cartridge case 102 in a state in which its left and right side end portions 131*a* and 131*b* and rear end portion 131*c* are inserted in the insertion grooves 123*a*, 124*a*, and 125*a* of the cartridge case 102. An obverse surface-side recess 151 is formed on an obverse surface 131*d* of this horizontal plate portion 131, and a reverse surface-side recess 161 is formed on a reverse surface 131*e* thereof. Each of the recesses 151 and 161 has a trapezoidal shape in each of the cross section shown in FIG. 7 and the cross section shown in FIG. 9.

Similarly, flexible films 153 and 163 respectively corresponding to the recesses 151 and 161 are also trapezoidal in each of the cross section shown in FIG. 7 and the cross section shown in FIG. 9. As in this modification, the flexible films 153 and 163 should preferably have shapes that respectively match the recesses 151 and 161.

The obverse surface 131*d* of the horizontal plate portion 131 has a planar surface 131*d*PS circumscribing a peripheral edge of a square opening of the recess 151. The planar surface 131*d*PS lies in one plane. Similarly, the reverse surface 131*e* has a planar surface 131*e*PS circumscribing a peripheral edge of a square opening of the recess 161. The planar surface 131*e*PS lies in one plane.

The films 153 and 163 have protruding portions (collapsible portions) 153*a* and 163*a* protruding in the shapes of quadrangular prisms, as well as flat portions 153*b* and 163*b* circumscribing outer peripheral edges of proximal end portions of these protruding portions.

The flat portion 153*b* is attached to that portion of the obverse surface 131*d* of the horizontal plate portion 131 that forms the planar surface 131*d*PS by ultrasonic welding, thermal welding, an adhesive agent, or the like, thereby forming a liquid-tight sealed portion. Similarly, the flat portion 163*b* is attached in a liquid-tight sealed state to that portion of the reverse surface 131*e* of the horizontal plate portion 131 that forms the planar surface 131*e*PS.

In FIGS. 7 to 9, when the ink is fully filled in the ink chamber 105, the film 153 is in the state shown by the solid lines. On the other hand, when all the ink in the ink chamber has been consumed, the film 153 assumes the state shown by the chain double-dashed lines. Namely, as the ink is consumed, the film 153 gradually moves from the state shown by the solid lines towards the recess 151, then collapses in such a manner as to be parallel to the inner surface of the recess 151, and finally assumes the state shown by the chain double-dashed lines. It should be noted that in a case where the ink is initially filled into the ink chamber 105 in the process of manufacturing the ink cartridge, the air inside the ink chamber 105 is sucked under a vacuum through the ink supply port 107 to thereby set the film 153 in the state shown by the chain double-dashed lines. Subsequently, it is preferably to fill the ink into the ink chamber 105 through the ink supply port 107.

In FIG. 9, the state of the film 161 in which all the ink in the ink chamber has been consumed is also shown by the chain double-dashed lines.

The ink supply ports 107 and 109 in the first modification project from the front plate portion 132. In the ink supply ports 107 and 109 in the first modification, one end of an ink path 173 is open at a bottom of a small-diameter circular hole 172 at a position offset from a common central axis of the circular hole 172 and a circular hole 171. The other end of the ink path 173 is open (174) at bottoms of the recesses 151 and 161. A plurality of ribs 176R, instead of the hollow shaft, are provided around an outer periphery of a valve 176 which is pressed against seal rubber 175 by a valve spring 177 (see FIG. 8). As the plurality of ribs 176R are brought into contact with and guided by an inner peripheral surface of the circular hole 172, the valve 176 is movable in the direction of the central axis of the small-diameter hole 172.

An arrangement may be provided such that an atmosphere communicating hole is formed in the cartridge case 102 and/or the front plate portion 132 of the base 103 to allow the atmospheric pressure to be applied to the ink chambers 105 and 106 when the inks are consumed. Further, an arrangement may be provided such that the cartridge case 102 and the base 103 are joined in an airtight state, and a pressure-air introducing port is formed in the cartridge case 102 and/or the front plate portion 132 of the base 103. This is to allow pressure exceeding the atmospheric pressure to be applied to the ink chambers 105 and 106 during the consumption of the inks by introducing pressurized air into an airtight space between the cartridge case and the ink chambers 105 and 106. It should be noted that in a case where one of the ink chambers 105 and 106 is used as a waste ink chamber, pressure exceeding the atmospheric pressure is applied to only the other one of the ink chambers 105 and 106. In this case, by rendering a joint between the base 103 and the cartridge case 102 in an airtight state, the base 103 is capable of splitting the inner space of the cartridge case 102 into mutually pressure-shielded regions (a region where the chamber 105 is disposed and a region where the chamber 106 is disposed).

Second Modification

Figure 10:
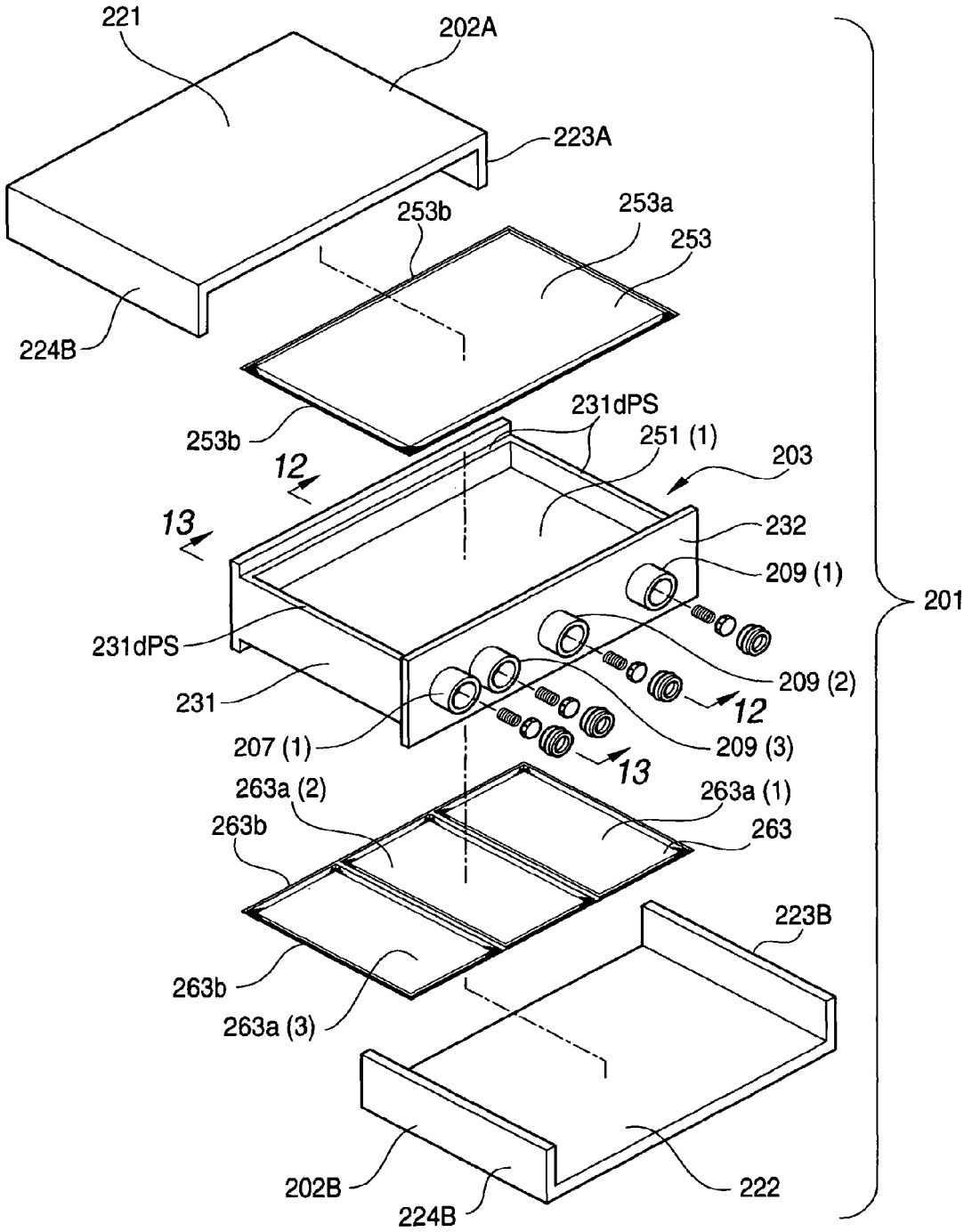
FIG. 10 is an exploded perspective view of an ink cartridge in accordance with a second modification.
Figure 11:
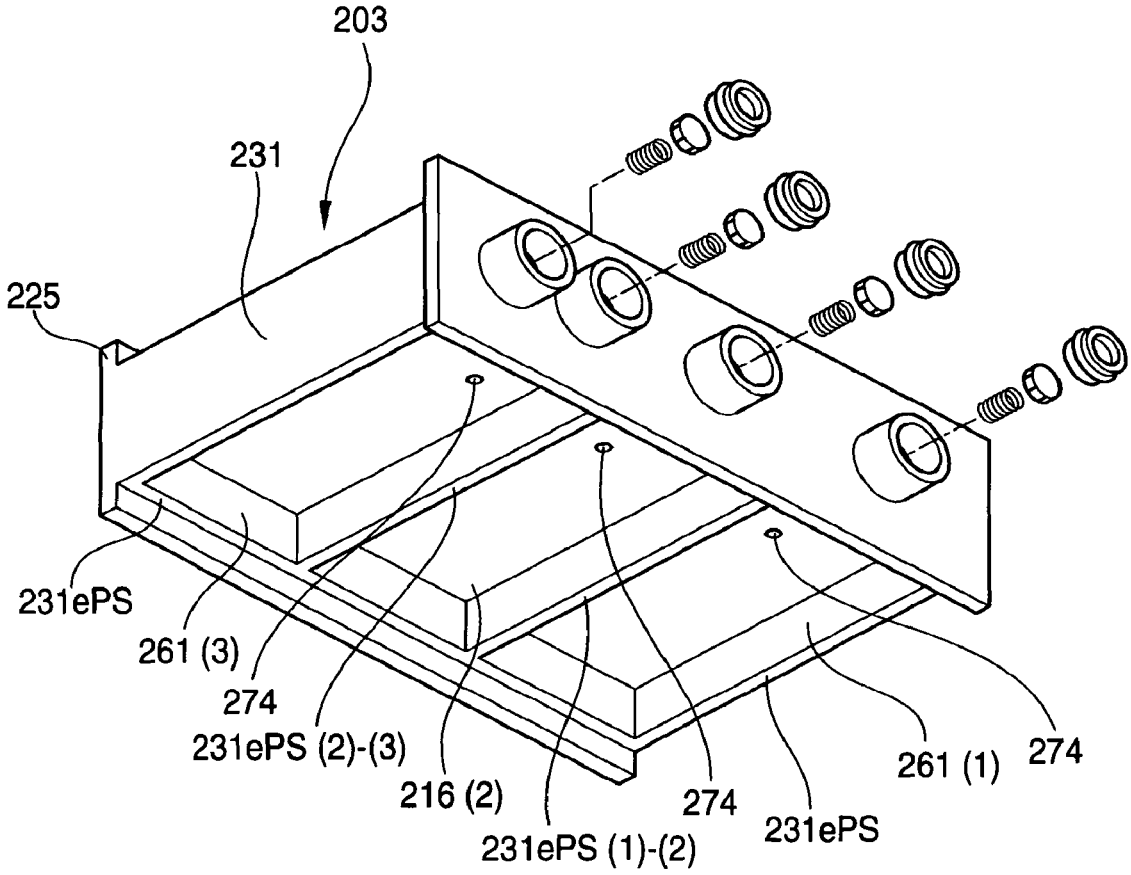
FIG. 11 is a perspective view, taken from below, of a base of the ink cartridge in accordance with the second modification.
Figure 12:
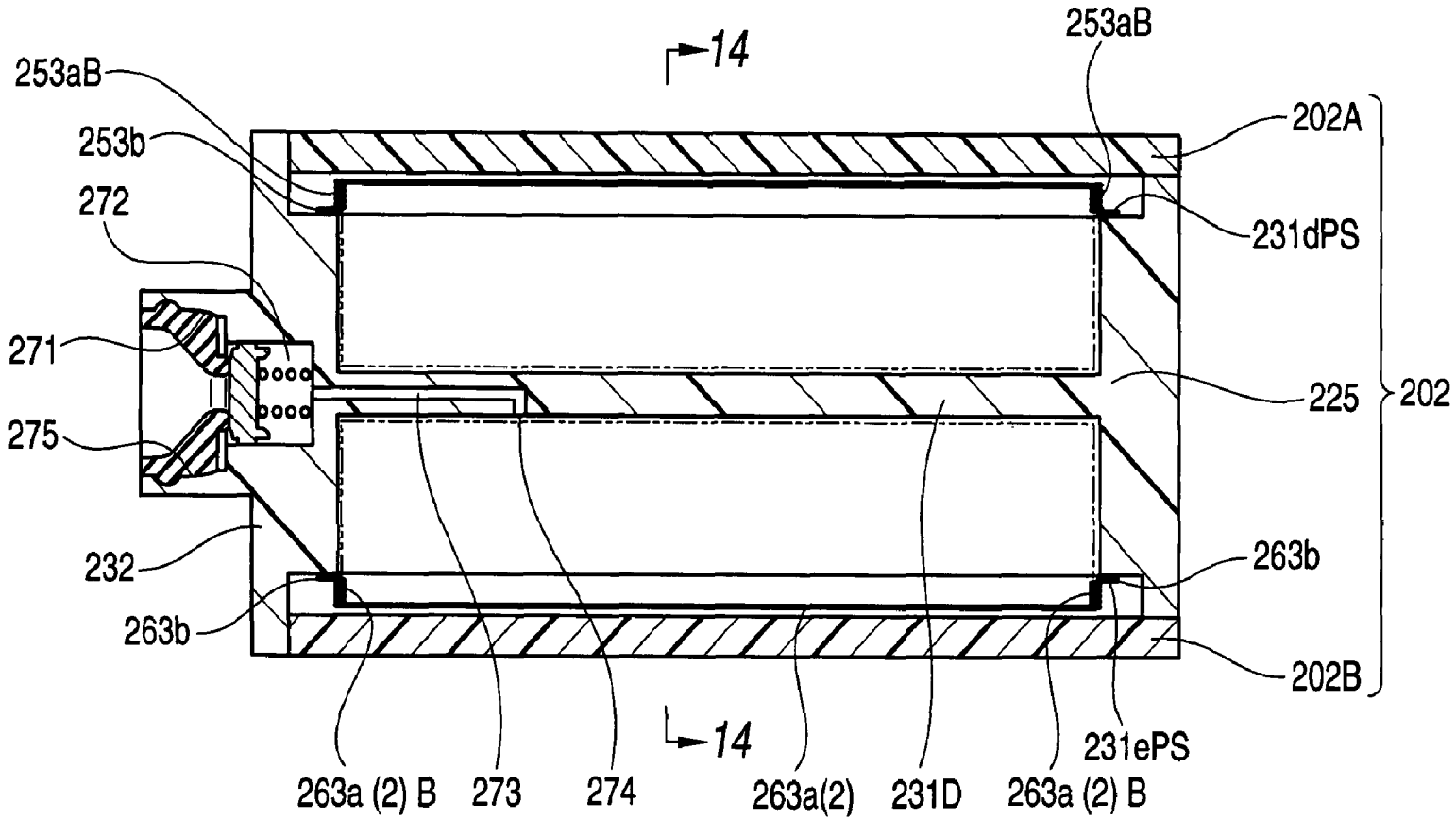
FIG. 12 is a transverse cross-sectional view, taken along line 12-12 in FIG. 10, of the ink cartridge.
Figure 13:
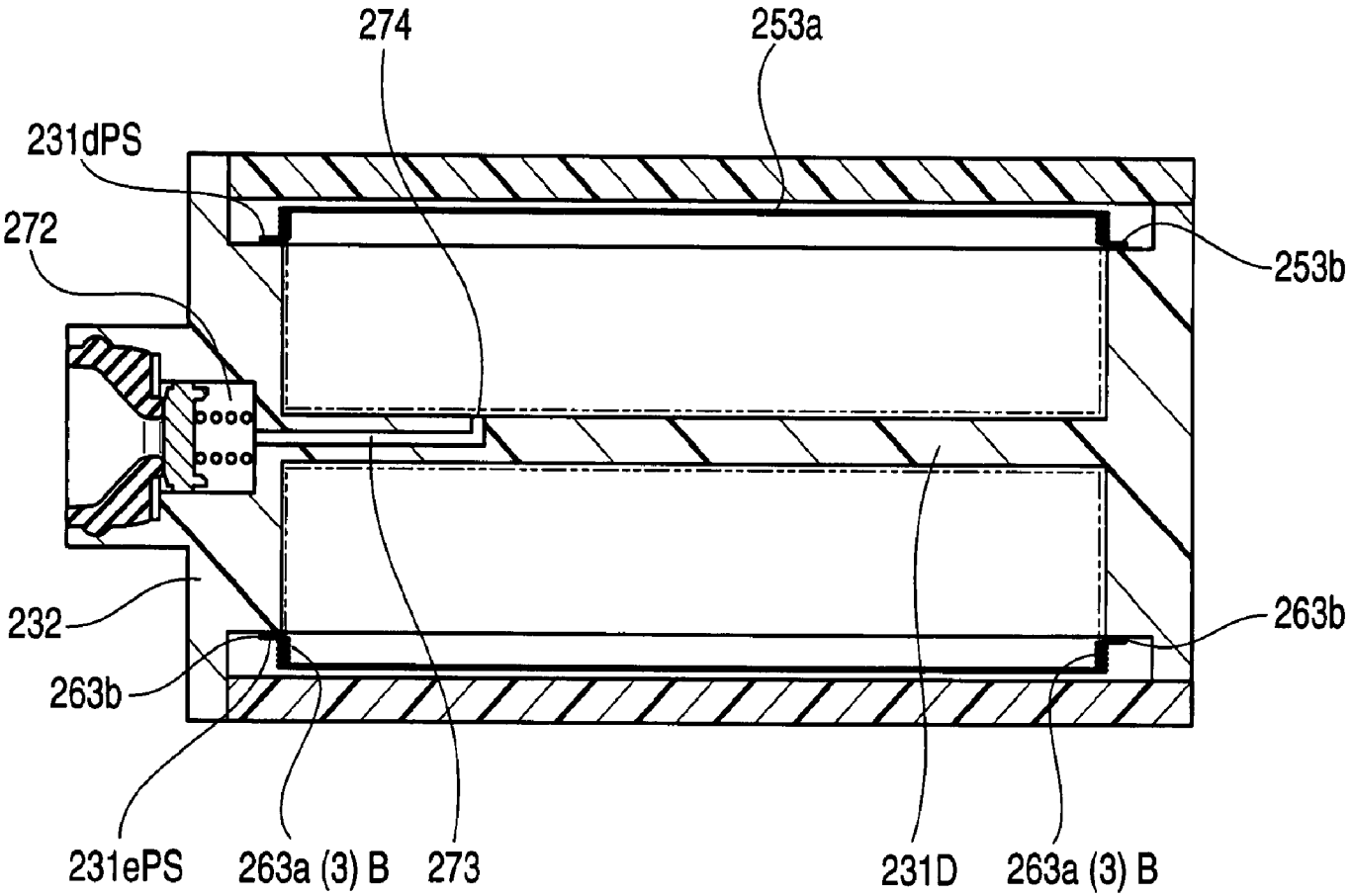
FIG. 13 is a transverse cross-sectional view, taken along line 13-13 in FIG. 10, of the ink cartridge.
Figure 14:
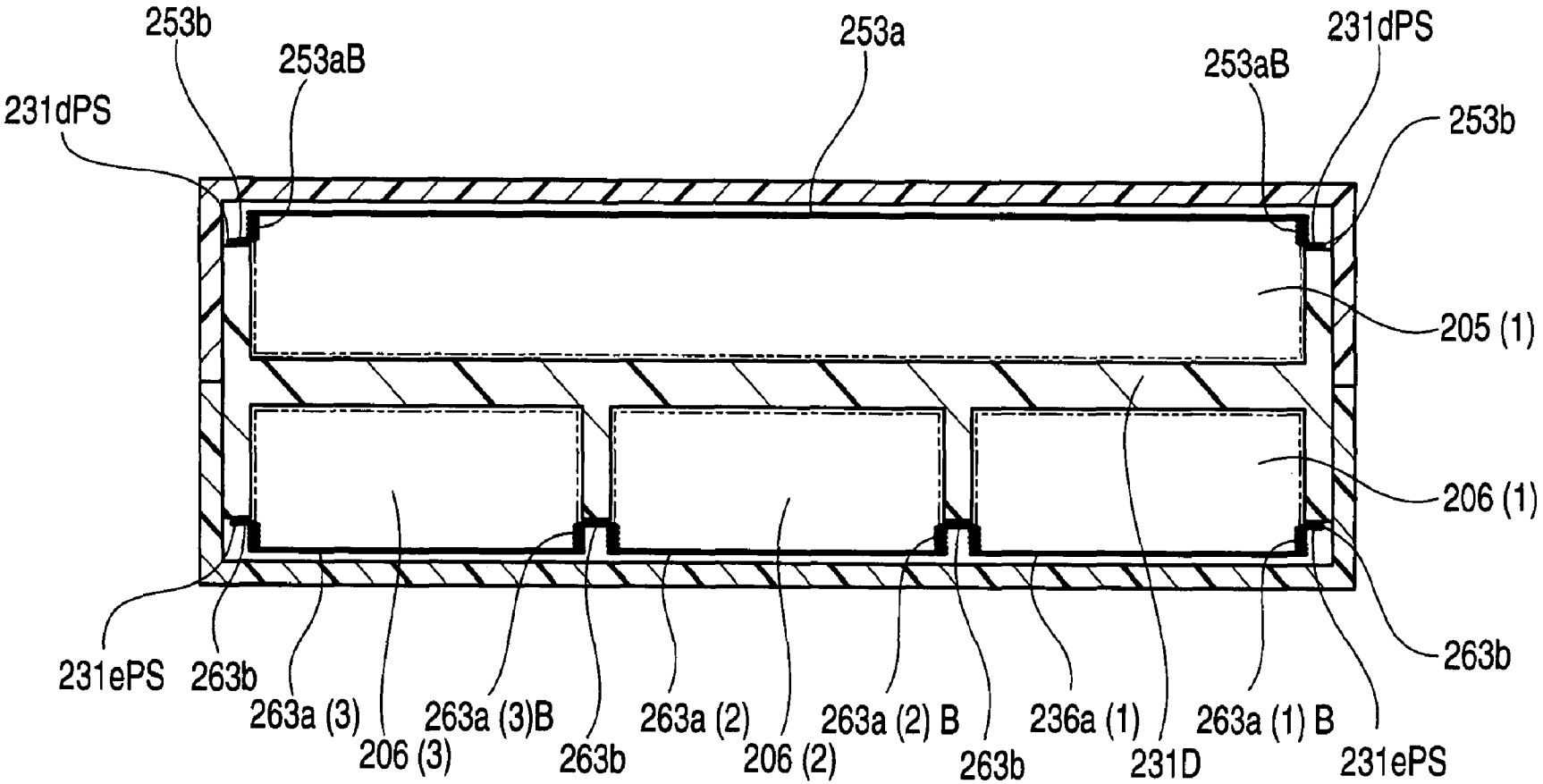
FIG. 14 is a cross-sectional view taken along line 14-14 in FIG. 12.

FIGS. 10 to 14 show an ink cartridge 201 in accordance with a second embodiment. FIG. 10 is an exploded perspective view of the ink cartridge 201; FIG. 11 is a perspective view, taken from below, of a base 203 of the ink cartridge 201; FIG. 12 is a transverse cross-sectional view, taken along line 12 to 12 in FIG. 10, of the ink cartridge 201; FIG. 13 is a transverse cross-sectional view, taken along line 13 to 13 in FIG. 10, of the ink cartridge 201; and FIG. 14 is a cross-sectional view taken along line 14 to 14 in FIG. 12.

The ink cartridge 201 in accordance with the second modification uses flexible films 253 and 263 of different shapes. Further, each of reverse surface-side recesses 261(1), 261(2), and 261(3) is different in size from an obverse surface-side recess 251(1), and the obverse surface-side recess 251(1) is larger than each of the reverse surface-side recesses 261(1), 261(2), and 261(3). An obverse surface-side ink chamber 205(1) is formed by the obverse surface-side flexible film 253 and an obverse surface-side recess 251, and a black ink, for example, is accommodated in this obverse surface-side ink chamber 205(1) A plurality of reverse surface-side ink chambers 206(1), 206(2), and 206(3) are formed by the reverse surface-side flexible film 263 and the plurality of reverse surface-side recesses 261(1), 261(2), and 261(3), and cyan, magenta, and yellow inks are respectively accommodated therein.

A cartridge case 202 consists of an obverse surface-side cartridge case 202A and a reverse surface-side cartridge case 202B, which are attached to the base 203 so as to cover the obverse surface-side flexible film 253 and the reverse surface-side flexible film 263 which are attached to the base 203. The obverse surface-side cartridge case 202A has an upper plate portion 221 and left and right side plate portions 223A and 224A. The reverse surface-side cartridge case 202B has a lower plate portion 222 and left and right side plate portions 223B and 224B. As the obverse surface-side cartridge case 202A and the reverse surface-side cartridge case 202B are combined, the left and right side plate portions 223A, 224A, 223B, and 224B form left and right side plate portions 223 and 224 of the cartridge case 202. A rear end plate portion 225 of the cartridge case 202, which constitutes a portion of outer walls of the ink cartridge 201, may be provided on the obverse surface-side cartridge case 202A and/or the reverse surface-side cartridge case 202B. In the second modification, however, the rear end plate portion 225 is provided on the base 203. If the cartridge cases 202A and 202B are attached to the base 203, a front plate portion 232 of the base 203 seals the front-side opening of the cartridge case 202, while the rear end plate portion 225 of the base 203 seals the rear-side opening of the cartridge case 202 (see FIG. 12).

The front plate portion 232 has ink supply ports 207(1), 209(1), 209(2), and 209(3) respectively communicating with the obverse surface-side ink chamber 205(1) and the reverse surface-side ink chambers 206(1), 206(2), and 206(3). The specific configurations (including valve mechanisms) of these ink supply ports 207(1), 209(1), 209(2), and 209(3) are similar to those of the first modification, so that a detailed description thereof will be omitted. Major points of change of the second modification from the first modification are as follows. The ink supply ports 207(1), 209(1), 209(2), and 209(3) are arranged in a row along a center line of the front plate portion 232. One end of an ink path 273 is open at a bottom of a small-diameter hole 272 on the common central axis of the circular hole 272 and a circular hole 271. The ink passage 273 extends through a partition wall 231P of a horizontal plate portion 231 of the base 203 for separating the obverse surface-side ink chamber 205(1) and the reverse-surface-side ink chambers 206(1), 206(2), and 206(3).

This partition wall 231P forms the respective bottoms of the obverse surface-side recess 251(1) and the reverse surface-side recesses 262(1), 262(2), and 262(3). Each of the recesses 251(1), 262(1), 262(2), and 262(3) has the shape of a quadrangular prism in the cross sections shown in FIGS. 12 to 14.

The horizontal plate portion 231 of the base 203 has a box shape in which the recesses 251(1), 262(1), 262(2), and 262(3) are formed. The horizontal plate portion 231 has aplanar surface 231*d*PS circumscribing a peripheral edge of a square opening of the recess 251(1). The planar surface 231*d*PS lies in one plane. Further, the horizontal plate portion 231 has a reverse surface-side planar surface 231*e*PS circumscribing all the square openings of the recesses 262(1), 262(2), and 262(3). The planar surface 231*e*PS lies in one plane. It should be noted that the planar surface 231*e*PS includes a planar surface 231*e*PS(1)-(2) located between the recesses 262(1) and 261(2) as well as a planar surface 231*e*PS(2)-(3) located between the recesses 262(2) and 261(3). The planar surface 231*e*PS(1)-(2) is adjacent to both of a portion of peripheral edges of the opening of the recess 262(1) and a portion of peripheral edges of the opening of the recess 262(2). Likewise, the planar surface 231*e*PS(2)-(3) is adjacent to both of the portion of the peripheral edges of the opening of the recess 262(2) and a portion of peripheral edges of the opening of the recess 262(3).

The flexible film 253 corresponding to the recess 252(1) has a collapsible portion 253*a* including a bellows portion 253*a*B where a fine bellows is formed, as well as a flat portion 253*b* circumscribing an outer peripheral edge of a proximal end portion of the collapsible portion 253*a*. The flat portion 253*b* is attached to the planar surface 131*d*PS of the horizontal plate portion 231 by ultrasonic welding, thermal welding, an adhesive agent, or the like, thereby forming a liquid-tight sealed portion.

The flexible film 263 corresponding to the recesses 261(1), 261(2), and 261(3) has a plurality of collapsible portions 263*a*(1), 263*a*(2), and 263*a*(3). The collapsible portions 263*a*(1), 263*a*(2), and 263*a*(3) respectively include bellows portions 263*a*(1)B, 263*a*(2)B, and 263*a*(3)B where fine bellows are formed. The film 263 further has a flat portion 263*b* circumscribing all the outer peripheral edges of proximal end portions of the collapsible portion 263*a*(1), 263*a*(2), and 263*a*(3). The flat portion 263*b* is attached to the planar surface 231*e*PS (including the planar surfaces 231*e*PS(1)-(2) and 231*e*PS(2)-(3)) of the horizontal plate portion 231 by ultrasonic welding, thermal welding, an adhesive agent, or the like, thereby forming a liquid-tight sealed portion.

In FIGS. 12 to 14, when the inks are fully filled in the ink chambers 205(1), 206(1), 206(2), and 206(3), the films 253 and 263 are in the state shown by the solid lines. On the other hand, when all the inks in the ink chambers have been consumed, the films 253 and 263 assume the state shown by the chain double-dashed lines. Namely, as the inks are consumed, the films 253 and 263 gradually move from the state shown by the solid lines towards the recesses 251(1), 261(1), 261(2), and 261(3), then collapse (are expanded) in such a manner as to be parallel to the inner surfaces of the recesses 251(1), 261(1), 261(2), and 261(3), and finally assume the state shown by the chain double-dashed lines.

An arrangement may be provided such that an atmosphere communicating hole is formed in the cartridge case 202 and/or the front plate portion 232 and/or the rear end plate portion 225 of the base 203 to allow the atmospheric pressure to be applied to the ink chambers 205(1), 206(1), 206(2), and 206(3) when the inks are consumed. Further, an arrangement may be provided such that the obverse surface-side cartridge case 202A and the reverse surface-side cartridge case 202B, on the one hand, and the base 203, on the other hand, are joined in an airtight state, and a pressure-air introducing port is formed in the cartridge case 202 and/or the front plate portion 232 and/or the rear end plate portion 225 of the base 203. This is to allow pressure exceeding the atmospheric pressure to be applied to the ink chambers 205(1), 206(1), 206(2), and 206(3) during the consumption of the inks by introducing pressurized air into an airtight space between the cartridge case and the ink chambers 205(1), 206(1), 206(2), and 206(3). A waste ink absorbent and a waste-ink collection port may be added to the ink cartridge 201.

Third Modification

FIGS. 15 to 17 show an ink cartridge 301 in accordance with the third modification. FIG. 15 is an exploded perspective view of the ink cartridge 301; FIG. 16 is a transverse cross-sectional view, taken along line 16-16 in FIG. 15, of the ink cartridge 301; and FIG. 17 is a cross-sectional view taken along line 17-17 in FIG. 16.

In the ink cartridge 301, a plurality of ink chambers 305(1), 305(2), 305(3), and 305(4) are formed by a plurality of obverse surface-side recesses 351(1), 351(2), 351(3), and 351(4) of a base 303, and black, cyan, magenta, and yellow inks are accommodated in the ink chambers 305(1), 305(2), 305(3), and 305(4). A waste ink chamber 306(1) is formed by a single reverse surface-side recess 361(1) of the base 303, and a waste ink absorbent 304 is accommodated in the waste ink chamber 306(1). The depth of the reverse surface-side recess 361(1) is shallow with respect to the obverse surface-side recesses 351(1), 351(2), 351(3), and 351(4). A front plate portion 332 of the base 303 has a waste-ink collection port 311 communicating with the waste ink chamber 306(1). A film 363 which is attached to a planar surface 331*e*PS circumscribing a square peripheral edge of the reverse surface-side recess 361(1) may not be flexible. An atmosphere communication hole communicating with the waste ink chamber 306(1) formed by the reverse surface-side recess 361(1) and the film 363 is formed in the front plate portion 332 and/or a rear end plate portion 325 of the base 303. The waste-ink collection port 311 and ink supply ports 307(1), 307(2), 307(3), and 307(4) are arranged on a straight line at a position offset to a lower side from a center line of the front plate portion 332 of the base 303.

Since the arrangements of the ink cartridge 301 in the third modification other than those described above are similar to those of the ink cartridge 201 in the second modification, a detailed description will be omitted.

An arrangement may be provided such that an atmosphere communicating hole is formed in an obverse surface-side cartridge case 302A and/or the front plate portion 332 and/or the rear end plate portion 325 of the base 303 to allow the atmospheric pressure to be applied to the ink chambers 305(1), 305(2), 305(3), and 305(4) when the inks are consumed. Further, an arrangement may be provided such that the obverse surface-side cartridge case 302A and the base 303 are joined in an airtight state, and a pressure-air introducing port is formed in the obverse surface-side cartridge case 302A and/or the front plate portion 332 and/or the rear end plate portion 325 of the base 303. This is to allow pressure exceeding the atmospheric pressure to be applied to the ink chambers 305(1), 305(2), 305(3), and 305(4) during the consumption of the inks by introducing pressurized air into an airtight space between the obverse surface-side cartridge case 302A and the ink chambers 305(1), 305(2), 305(3), and 305(4).

As described above, the present invention is very useful in rendering compact a liquid container having a plurality of liquid accommodating chambers, such as the multicolor-use ink cartridge. In addition, according to the present invention, it is possible to easily form a liquid container having high sealability. Furthermore, according to the present invention, it is possible to prevent the pressure of a liquid accommodated in one liquid accommodating chamber from affecting the pressure of a liquid accommodated in another liquid accommodating chamber.

What is claimed is:

1. A liquid container comprising:

a plurality of liquid containing portions each containing a liquid therein, each of the liquid containing portions defined by a corresponding base portion and a corresponding flexible film portion, the base portion including a first face and a second face perpendicular to the first face, the flexible film portion opposed to the first face;

a plurality of liquid supply ports arrayed in a line at a front plate portion of the liquid container, each of which communicates with a respective one of the plurality of liquid containing portions and supplies the liquid from the respective one of the plurality of liquid containing portions therethrough, the plurality of liquid supply ports each disposed in the second face of the base portion of the respective one of the plurality of liquid containing portions;

a waste liquid collecting portion for collecting a waste liquid therein; and a waste liquid collection port communicating with the waste liquid collecting portion.

2. The liquid container according to claim 1, further comprising a waste liquid absorbent disposed in the waste liquid collecting portion, and the liquid containing portion is at least partially separated from the waste liquid collecting portion by the flexible film portion.

3. The liquid container according to claim 1, wherein the liquid containing portion is in part separated from the waste liquid collecting portion by the flexible film portion.

4. The liquid container according to claim 1, wherein the waste liquid collection port is disposed at the front plate portion.

5. A liquid container comprising:

a plurality of liquid containing portions each containing a liquid therein, each of the liquid containing portions defined by a corresponding base portion and a corresponding flexible film portion, the base portion including a first face and a second face perpendicular to the first face, the flexible film portion opposed to the first face;

a plurality of liquid supply ports disposed at a front plate portion of the liquid container, each of which communicates with a respective one of the plurality of liquid containing portions and supplies the liquid from the respective one of the plurality of liquid containing portions therethrough, the plurality of liquid supply ports each disposed in the second face of the base portion of the respective one of the plurality of liquid containing portions; and a waste liquid collection port for leading a waste liquid to a waste liquid absorbent disposed in the liquid container, and the waste liquid collection port is disposed at the front plate portion of the liquid container.

6. The liquid container according to claim 5, wherein the liquid containing portion is in part separated from the waste liquid collecting portion by the flexible film portion.

7. A liquid container comprising:

a first case detachably attached to a liquid ejecting apparatus;

a plurality of liquid containing portions each containing a liquid therein, each of the liquid containing portions defined by a corresponding base portion and a corresponding flexible film portion, the film portion attached to the base portion, the liquid containing portions provided on the first case; and a plurality of liquid supply ports arrayed in a line at a front plate portion of the liquid container, the plurality of liquid supply ports each of which communicates with a respective one of the plurality of liquid containing portions and supplies the liquid, to the liquid ejecting apparatus, from the respective one of the plurality of liquid containing portions therethrough, the plurality of liquid supply ports being integrally formed as a part of the liquid container and being supported by a plate member, the plate member in contact with the liquid ejecting apparatus and perpendicular to a face of the base portion which face is opposed to the flexible film member.

8. The liquid container according to claim 7, wherein an opening of the base portion that is covered by the flexible film portion is positioned in a plane perpendicular to the front plate portion of the liquid container.

9. The liquid container according to claim 7, further comprising:

a second case, coupled to the first case so as to accommodate the plurality of the liquid containing portions.

10. The liquid container according to claim 7, further comprising a plurality of valve members, each of which is disposed in a respective one of the plurality of liquid supply ports.

11. The liquid container according to claim 7, wherein the base portion and the film portion are thermally welded.

12. The liquid container according to claim 7, wherein the plurality of liquid supply ports are supported by one plate member.

13. The liquid container according to claim 12, wherein the plate member communicates with the plurality of liquid containing portions.

14. A liquid container comprising:

a case detachably attached to a liquid ejecting apparatus;

a plurality of liquid containing portions each containing a liquid therein, each of the liquid containing portions defined by a base portion and a flexible film portion, the base portion including a first face and a second face perpendicular to the first face, the flexible film portion attached to the base portion and opposed to the first face, the liquid containing portions provided on the case; and a plurality of liquid supply ports arrayed in a line at a front plate portion of the liquid container, each of which communicates with a respective one of the plurality of liquid containing portions and supplies the liquid, to the liquid ejecting apparatus, from the respective one of the plurality of liquid containing portions therethrough, each of the plurality of liquid supply ports disposed in the second face of the base portion of its respective one of the plurality of liquid containing portions, the plurality of liquid supply ports being integrally formed as a part of the liquid container and being supported by a plate member, the plate member in contact with the liquid ejecting apparatus and perpendicular to the first face.

15. The liquid container according to claim 14, wherein the base portion has a plurality of partition walls that protrude from a bottom plate of the base portion so as to define the plurality of liquid containing portions.

16. The liquid container according to claim 14, further comprising a lid member covering the film portion attached to the base portion.

17. The liquid container according to claim 14, wherein an opening of the base portion that is covered by the flexible film portion is positioned in a plane perpendicular to the front plate portion of the liquid container.

18. The liquid container according to claim 14, further comprising a plurality of valve members, each of which is disposed in a respective one of the plurality of liquid supply ports.

19. The liquid container according to claim 14, wherein the base portion and the film portion are thermally welded.

20. The liquid container according to claim 14, wherein the plurality of liquid supply ports are supported by one plate member.

21. The liquid container according to claim 20, wherein the plate member communicates with the plurality of liquid containing portions.

22. A liquid container comprising:

a case detachably attached to a liquid ejecting apparatus; and a plurality of liquid containing portions each containing a liquid therein, the plurality of liquid containing portions defined in a chamber, the chamber formed by a plurality of recesses and at least one film portion, each of the liquid containing portions corresponding to respective one of the recesses, the liquid containing portions provided on the case, each of the plurality of recesses including a first face and a second face, the second face being perpendicular to the first face and provided with a liquid supply port for leading out the liquid contained therein, wherein the at least one film portion is opposed to the first face and the plurality of liquid supply ports are integrally formed as a part of the liquid container, and wherein faces, each of which forms an opening of the recess, are located in one plane.

23. The liquid container according to claim 22, further comprising a waste liquid collecting portion in which a waste liquid can be contained.

24. The liquid container according to claim 23, further comprising a waste liquid absorbent disposed in the waste liquid collecting portion.

25. The liquid container according to claim 22, wherein the liquid supply ports are arrayed in a line in a direction in which the plurality of the liquid containing portions are arranged.

26. The liquid container according to claim 22, wherein the recesses are formed by one base member.

27. The liquid container according to claim 22, wherein the case includes a first container case and a second container case, and the liquid containing portions are covered by the first container case and the second container case.

28. The liquid container according to claim 22, wherein the liquid supply ports are supported by one plate member.

29. The liquid container according to claim 28, wherein the plate member communicates with the plurality of liquid containing portions.

* * * * *